US007075507B2

(12) United States Patent
Ozawa et al.

(10) Patent No.: US 7,075,507 B2
(45) Date of Patent: Jul. 11, 2006

(54) ELECTRO-OPTICAL DEVICE, GRAY SCALE DISPLAY METHOD, AND ELECTRONIC APPARATUS

(75) Inventors: Tokuro Ozawa, Suwa (JP); Hideto Ishiguro, Shiojri (JP)

(73) Assignee: Seiko Epson Corporation, Tokyo (JP)

( * ) Notice: Subject to any disclaimer, the term of this patent is extended or adjusted under 35 U.S.C. 154(b) by 820 days.

(21) Appl. No.: 10/002,121

(22) Filed: Dec. 5, 2001

(65) Prior Publication Data

US 2002/0067327 A1 Jun. 6, 2002

(30) Foreign Application Priority Data

Dec. 5, 2000 (JP) ..... 2000-369906

(51) Int. Cl.
*G09G 3/36* (2006.01)

(52) U.S. Cl. ..... 345/89; 345/98

(58) Field of Classification Search ..... 345/89, 345/90, 94, 98, 99
See application file for complete search history.

(56) References Cited

U.S. PATENT DOCUMENTS 5,488,387 A * 1/1996 Maeda et al. ..... 345/89
5,534,884 A * 7/1996 Mase et al. ..... 345/87
5,712,652 A * 1/1998 Sato et al. ..... 345/90
5,945,972 A * 8/1999 Okumura et al. ..... 345/98
6,636,194 B1 10/2003 Ishii
6,765,549 B1 * 7/2004 Yamazaki et al. ..... 345/80

FOREIGN PATENT DOCUMENTS

| | | |
|---|---|---|
| JP | A-8-194205 | 7/1996 |
| JP | A 11-002797 | 1/1999 |
| WO | WO 00/08625 | 2/2000 |

* cited by examiner

*Primary Examiner*—Amr A. Awad
*Assistant Examiner*—Tom Sheng
(74) *Attorney, Agent, or Firm*—Oliff & Berridge, PLC

(57) ABSTRACT

The invention produces a high-quality display, in which the occurrence of display variations is reduced, with low power consumption. One field is divided into subfields corresponding to the bits of gray scale data, and the period of each subfield is set in such a manner as to correspond to the weight of each bit. A pixel includes memories that store bits of the gray scale data, a selector that selects a memory that stores the bit corresponding to the subfield from among these memories, a closed loop of inverters, and a TFT that reads and latches the bits stored in the selected memory and that rewrites into the selected memory, and complementary switches that select, with respect to a pixel electrode, a voltage corresponding to an ON display signal or an OFF display signal in accordance with the bit read from the selected memory.

12 Claims, 16 Drawing Sheets

[Fig. 1]
(a)
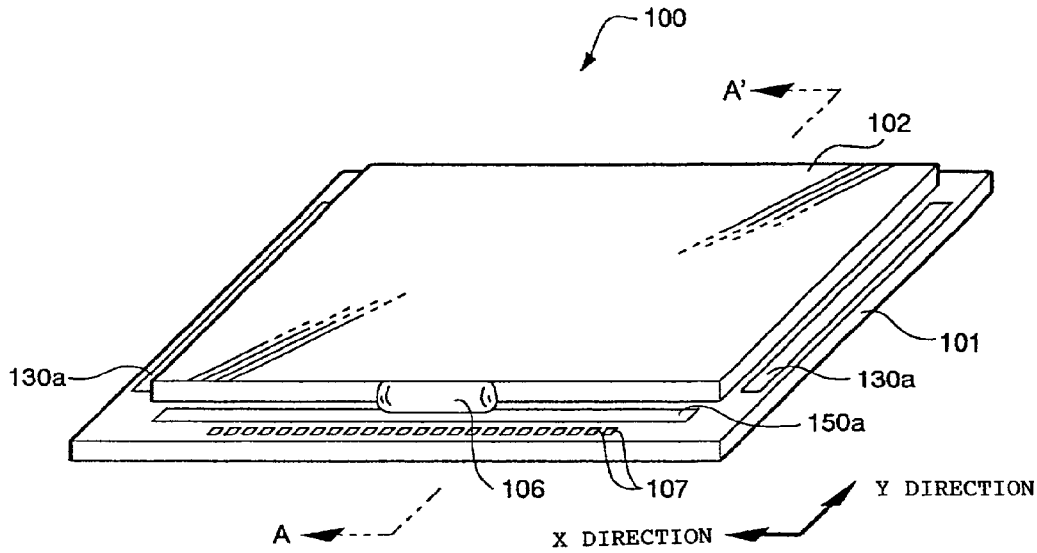
(b)
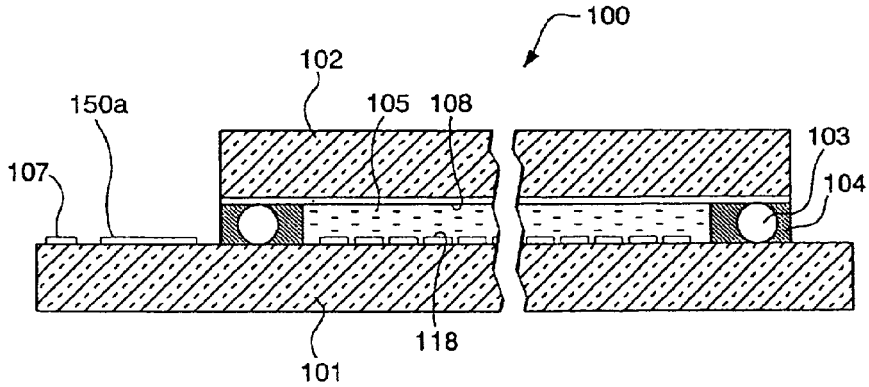

[Fig. 2]
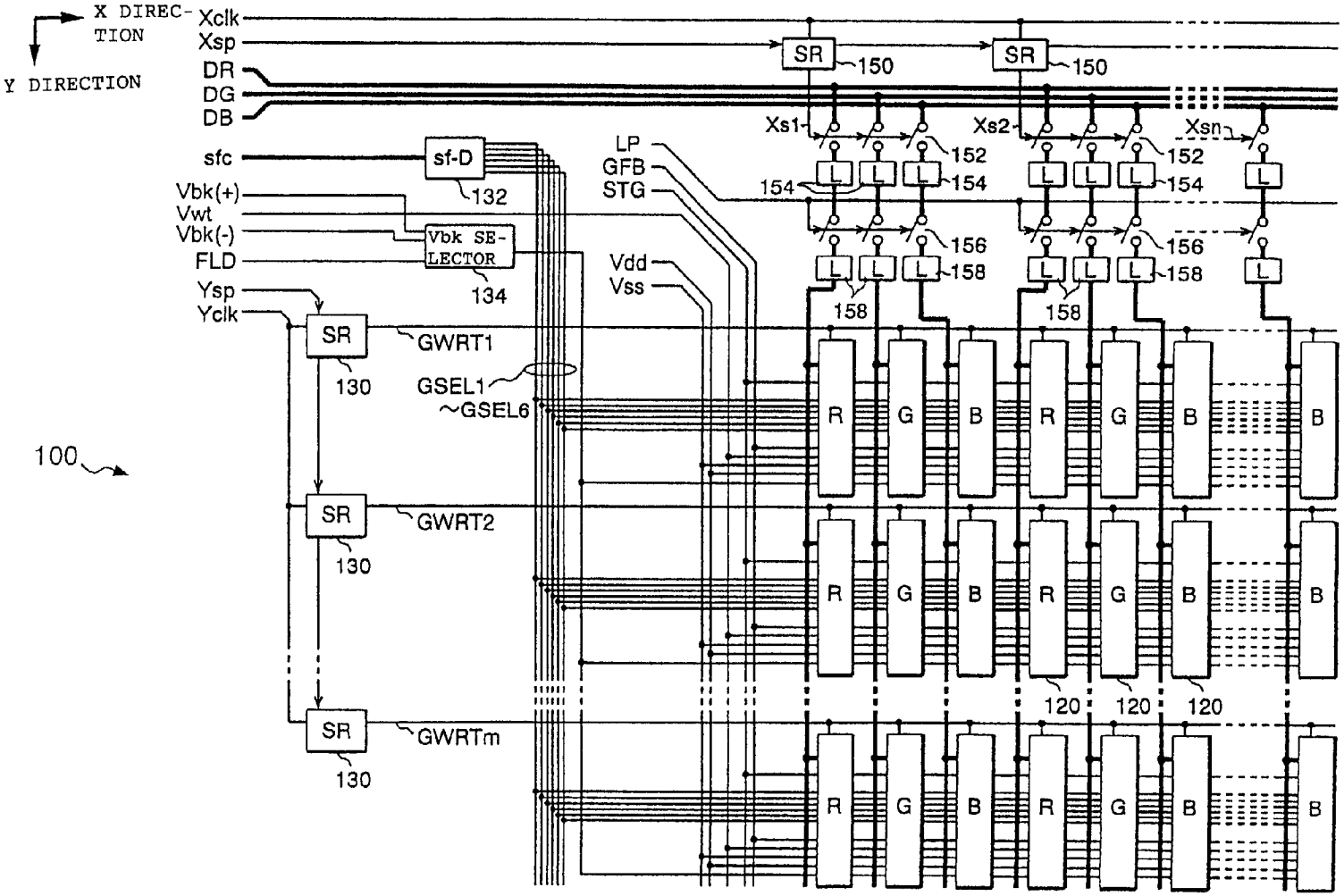

[Fig. 3]
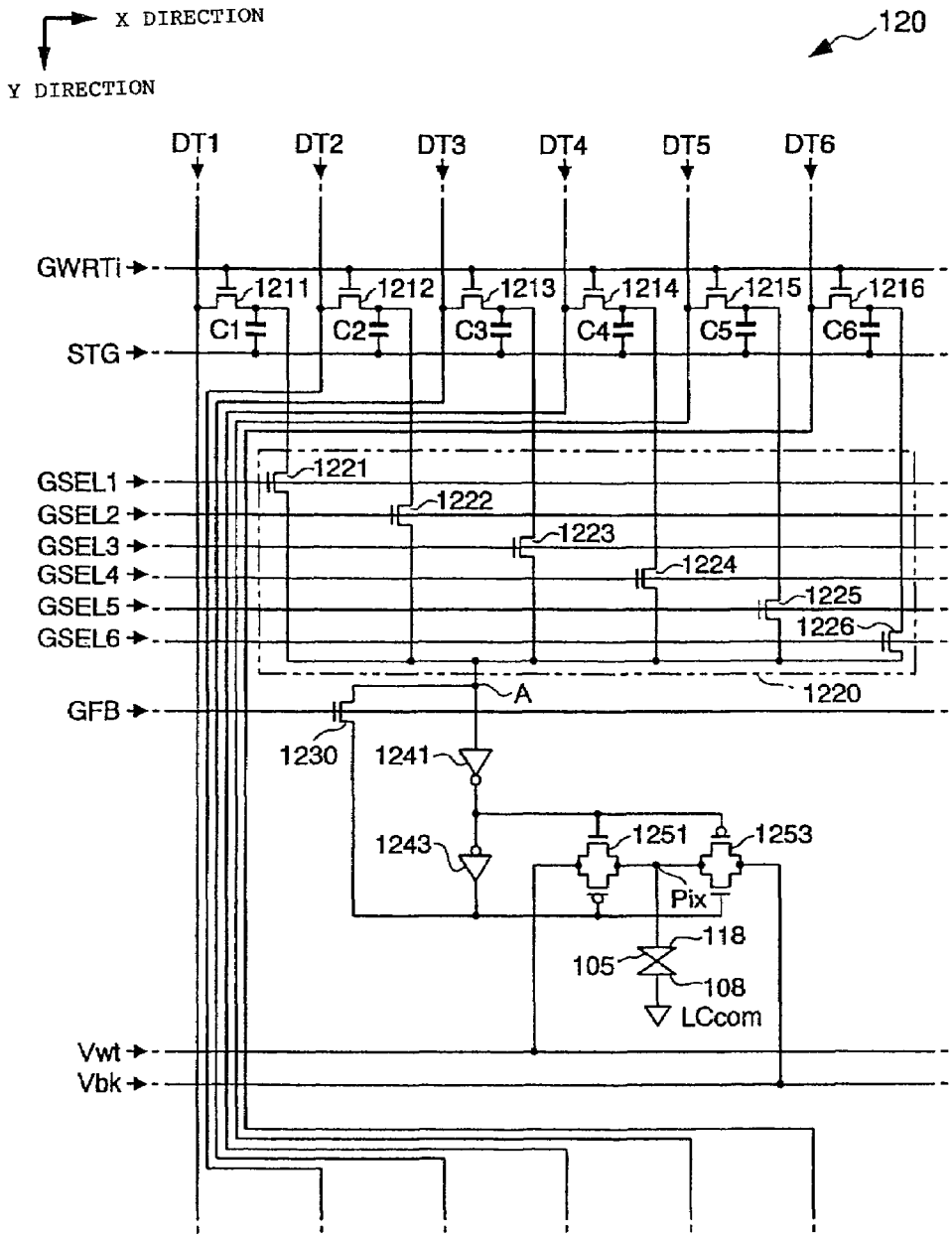

[Fig. 4]
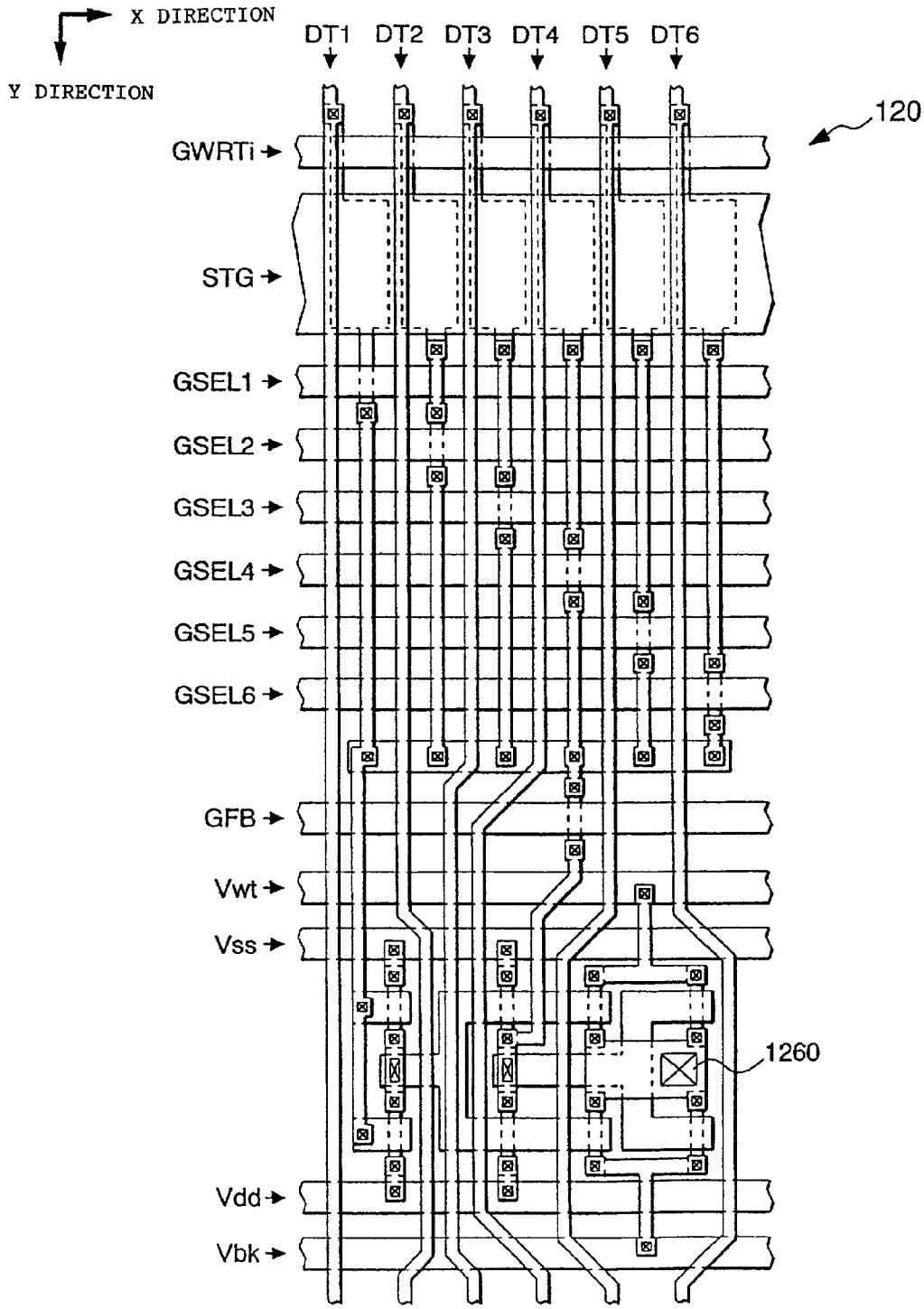

[Fig. 5]
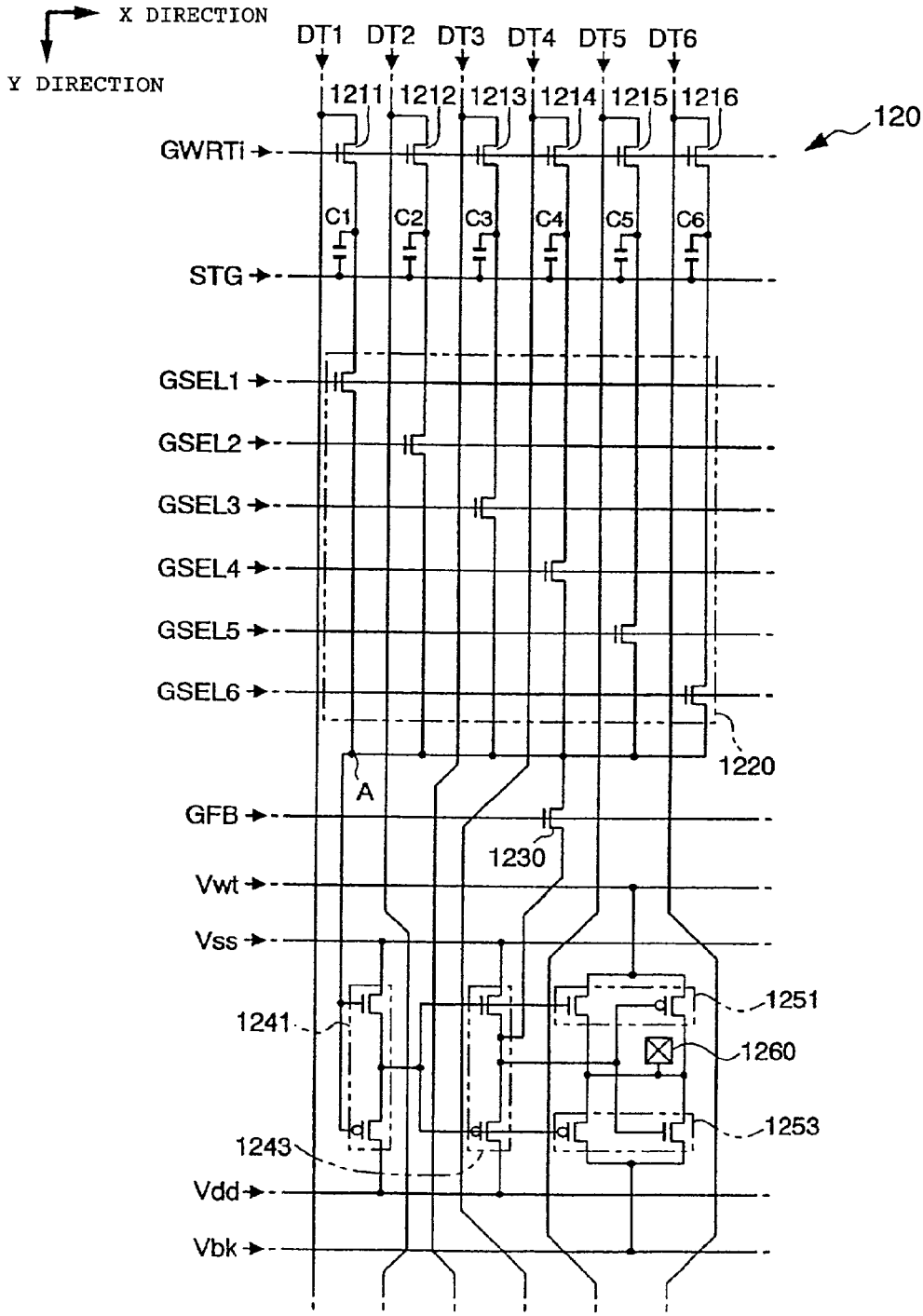

[Fig. 6]
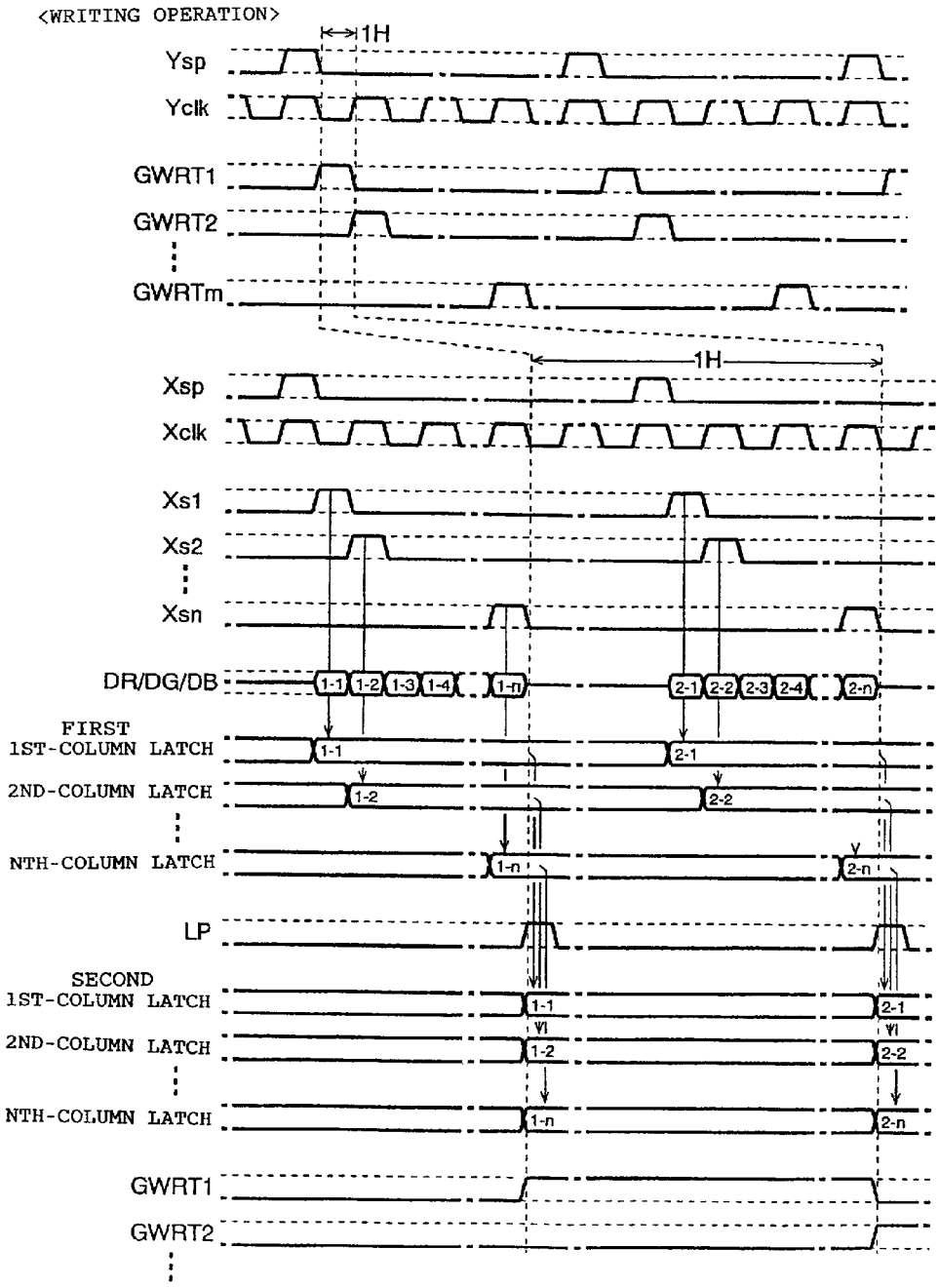

[Fig. 7]
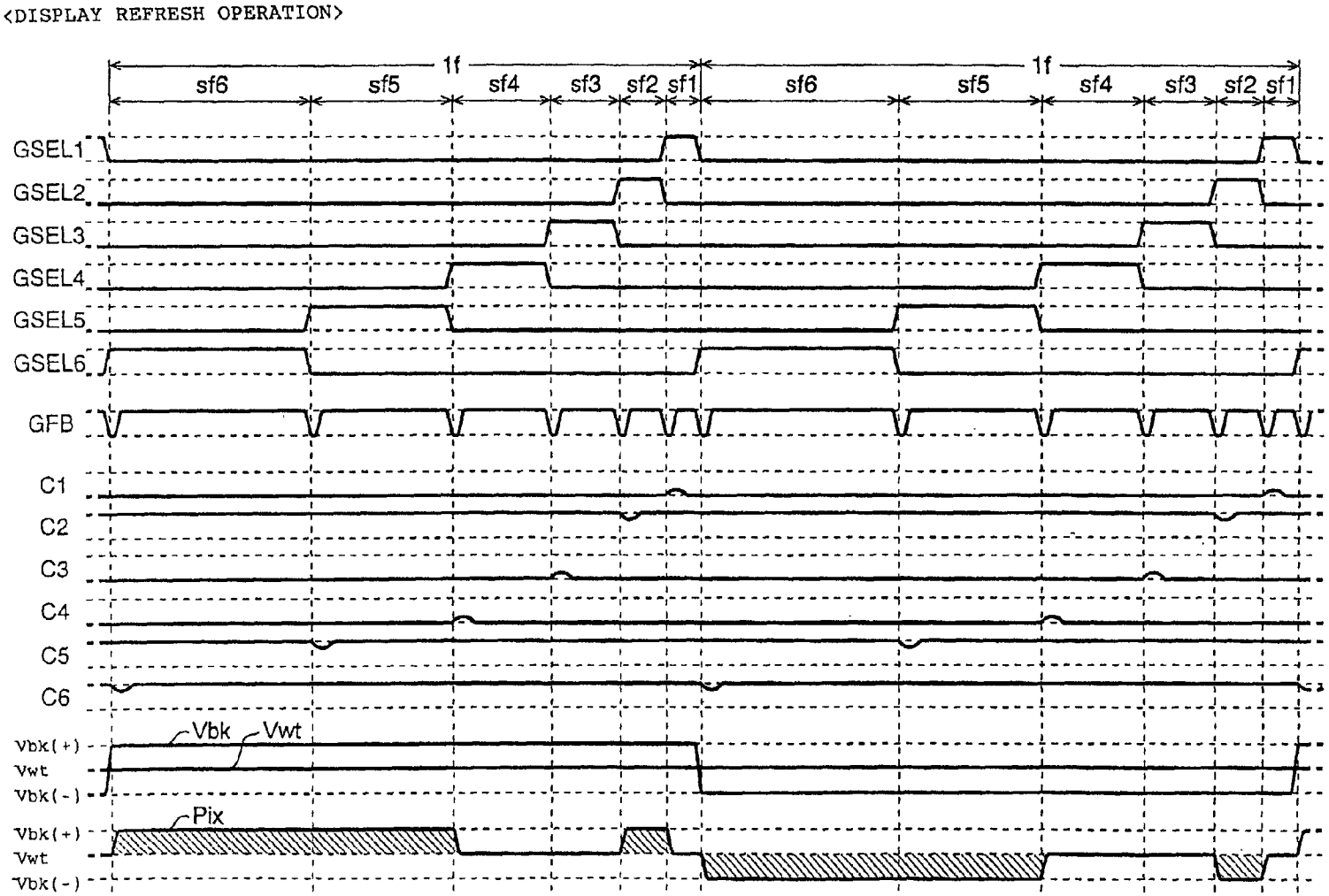

[Fig. 8]
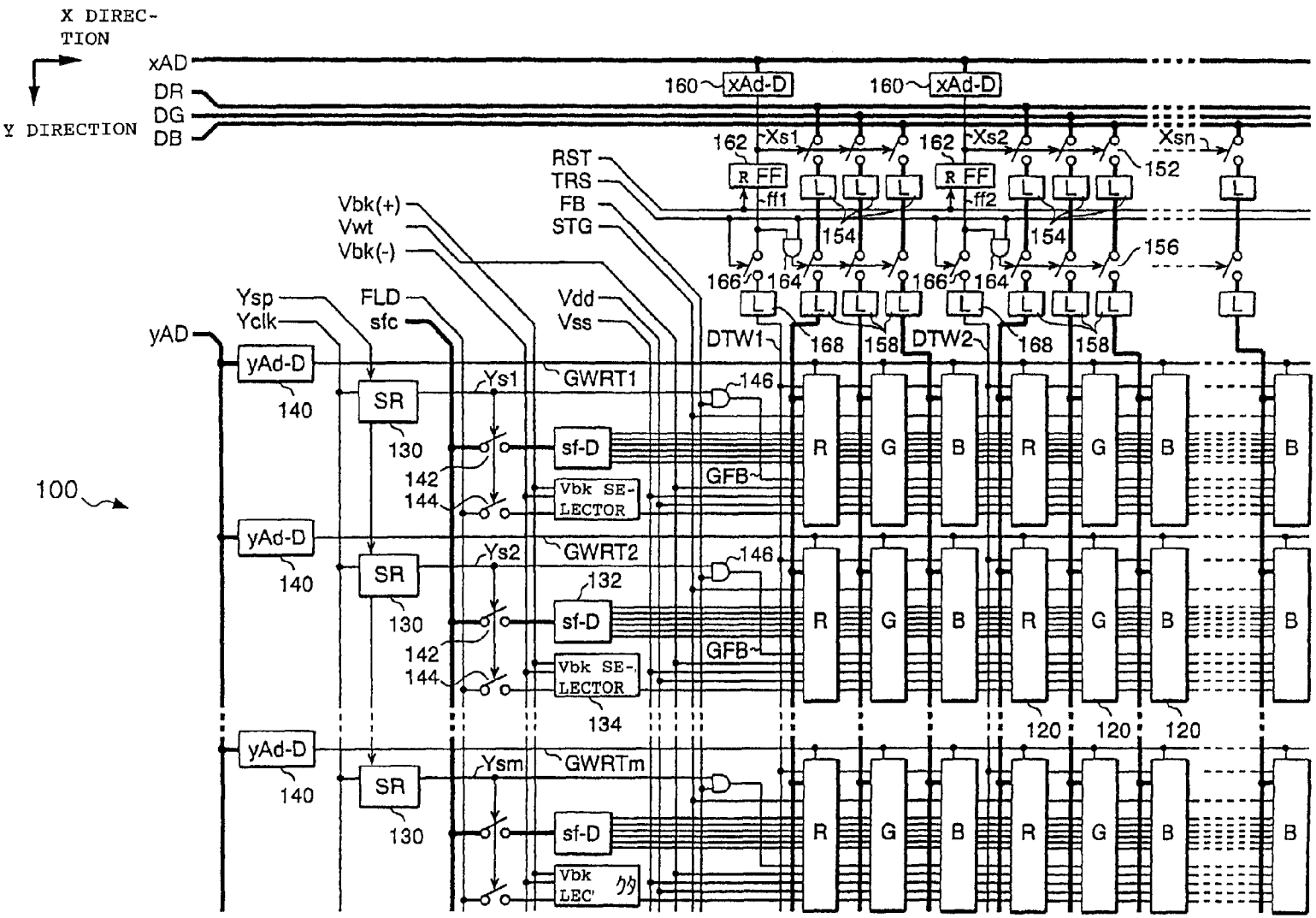

[Fig. 9]
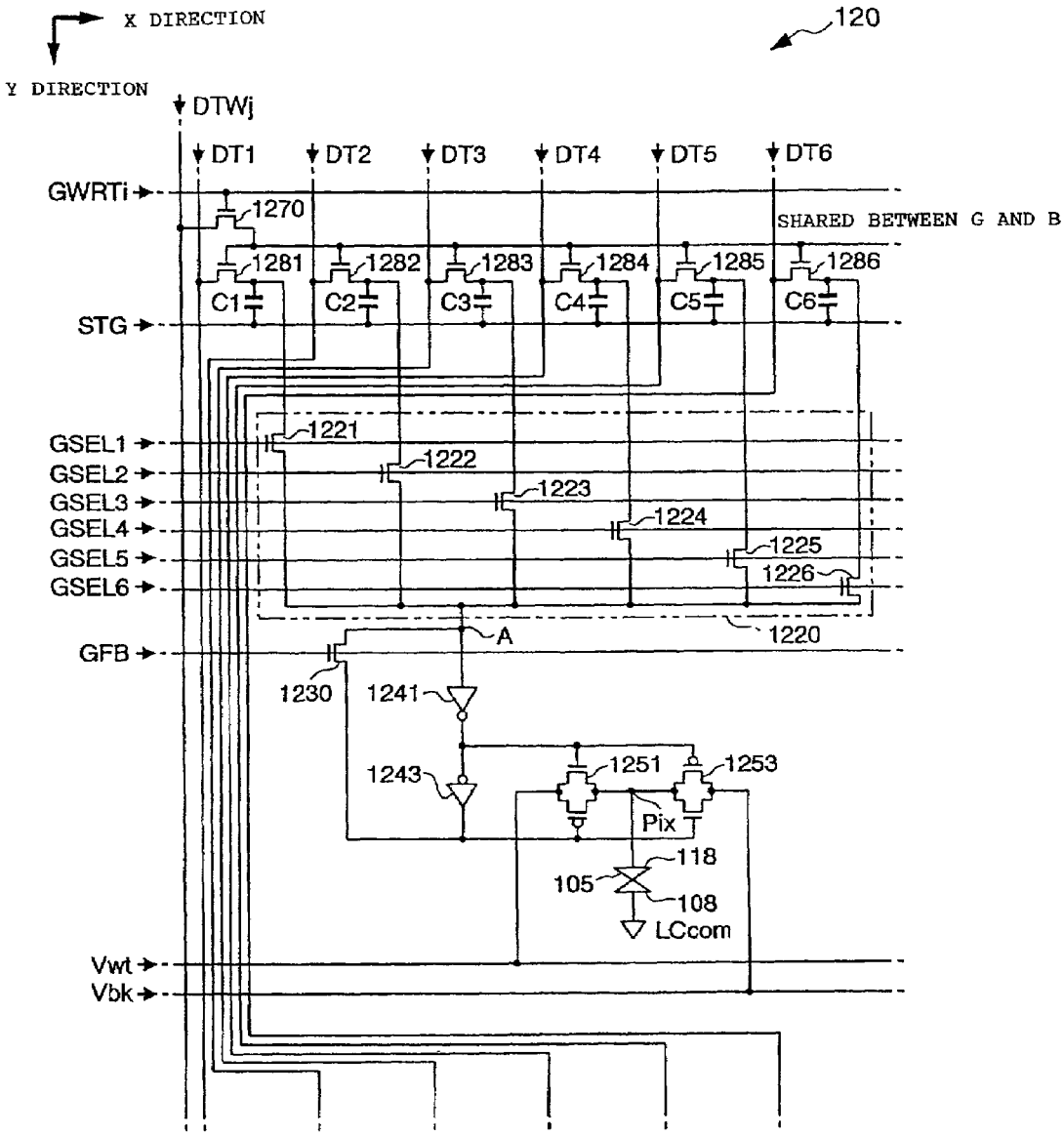

[Fig. 10]
<WRITING OPERATION>
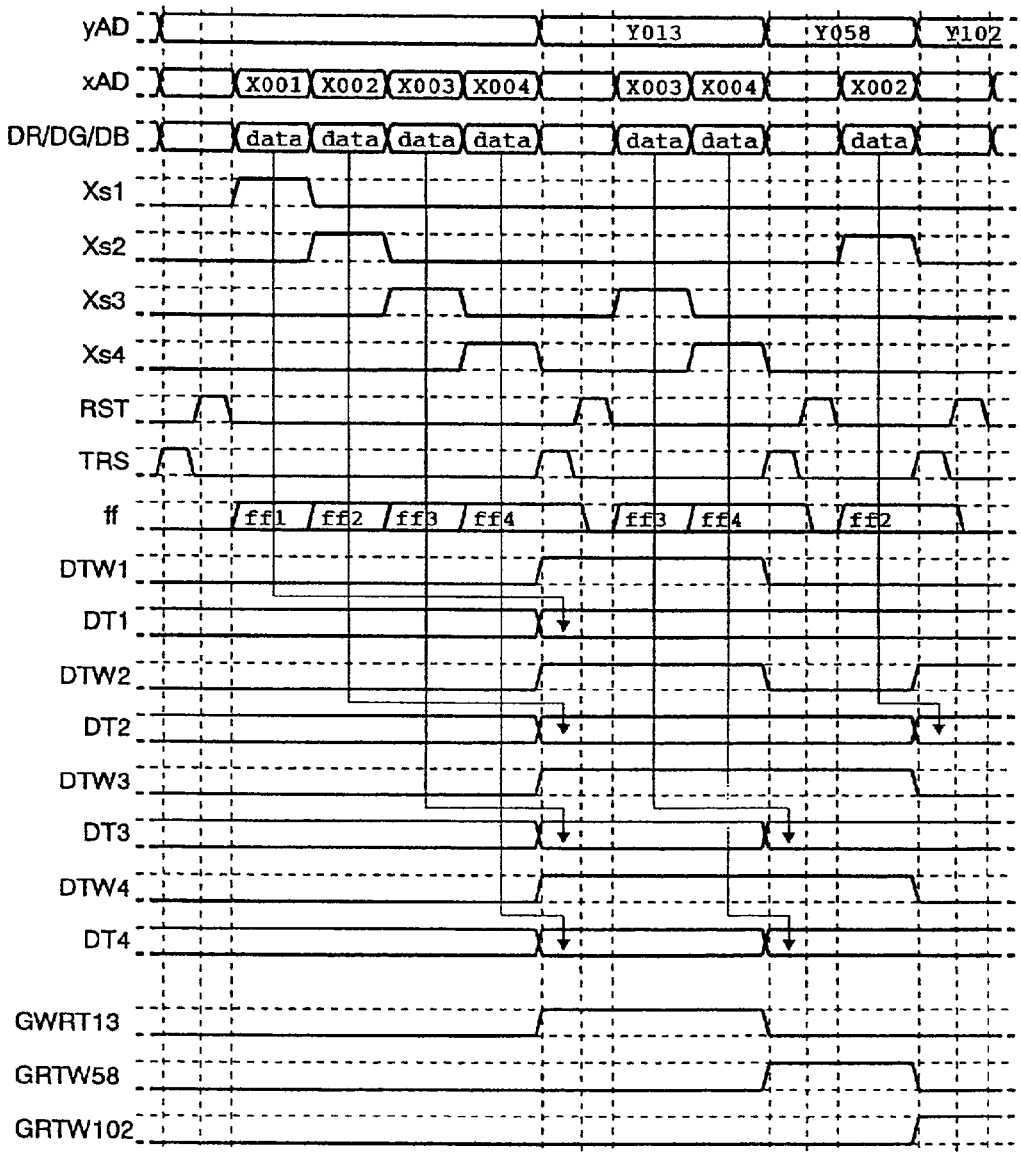

[Fig. 11]
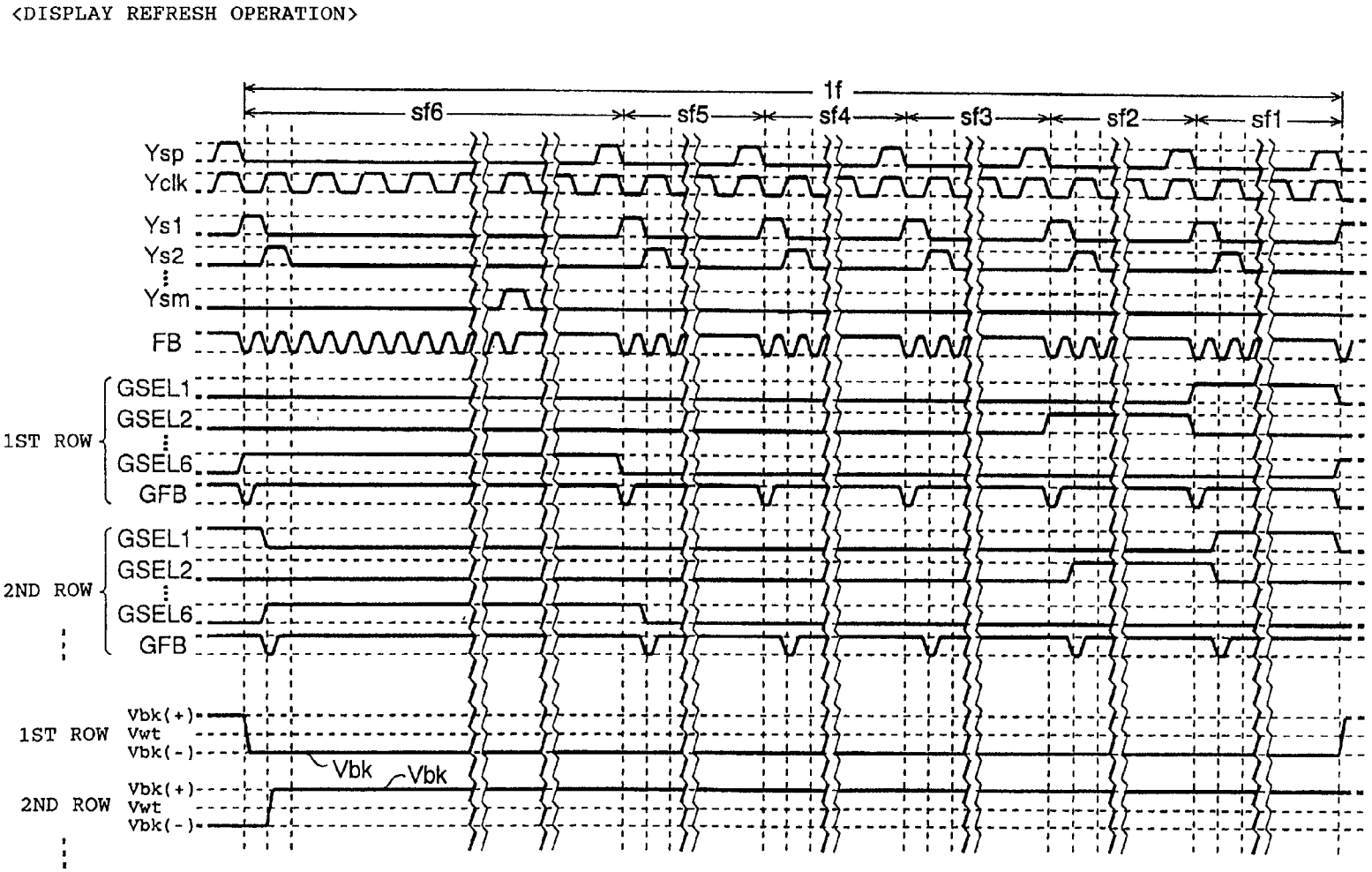
<DISPLAY REFRESH OPERATION>

[Fig. 12]
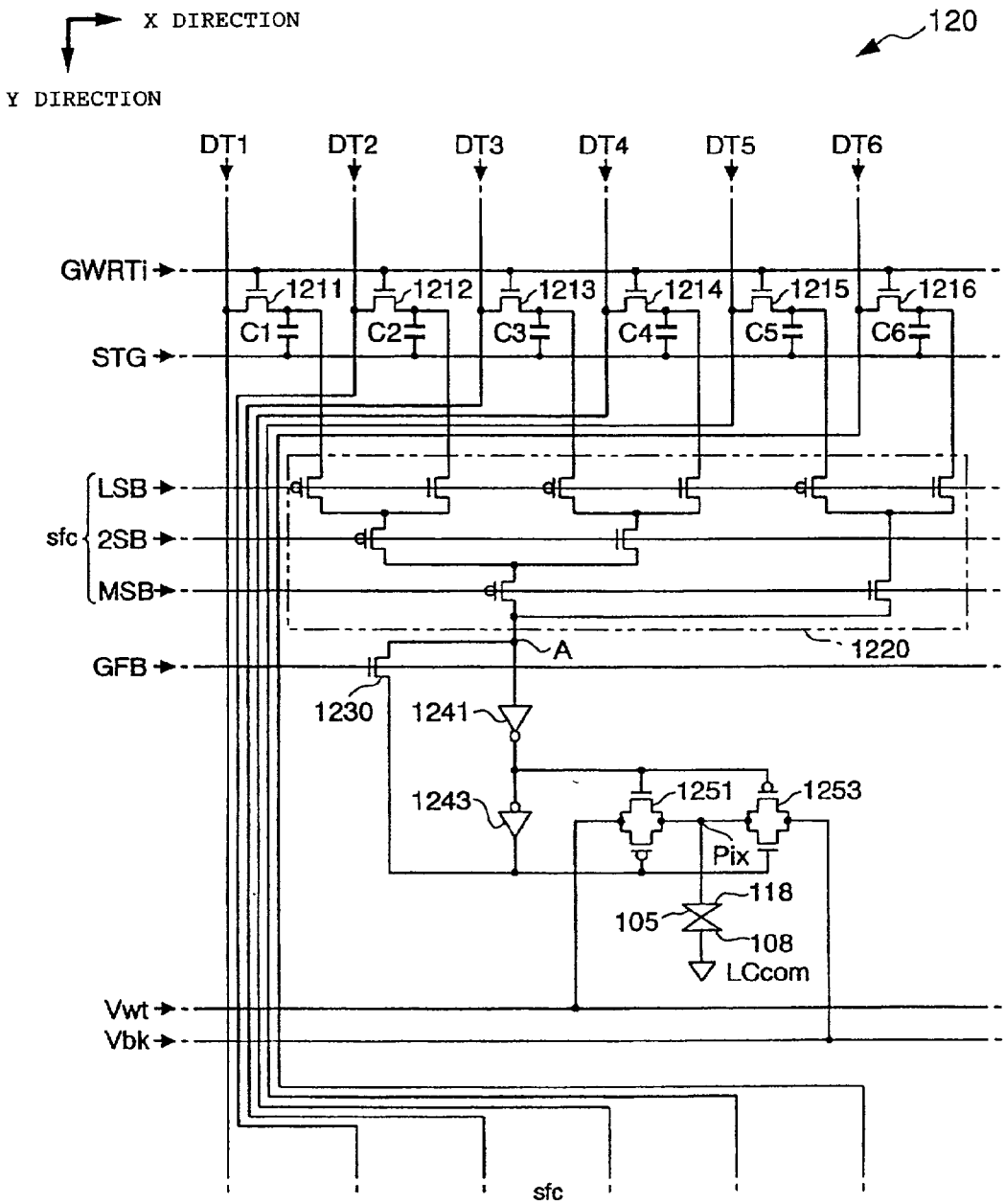
| sfc | | | |
|---|---|---|---|
| MSB | 2SB | LSB | |
| 0 | 0 | 0 | ---- sf1 |
| 0 | 0 | 1 | ---- sf2 |
| 0 | 1 | 0 | ---- sf3 |
| 0 | 1 | 1 | ---- sf4 |
| 1 | - | 0 | ---- sf5 |
| 1 | - | 1 | ---- sf6 |
1=H, 0=L

[Fig. 13]
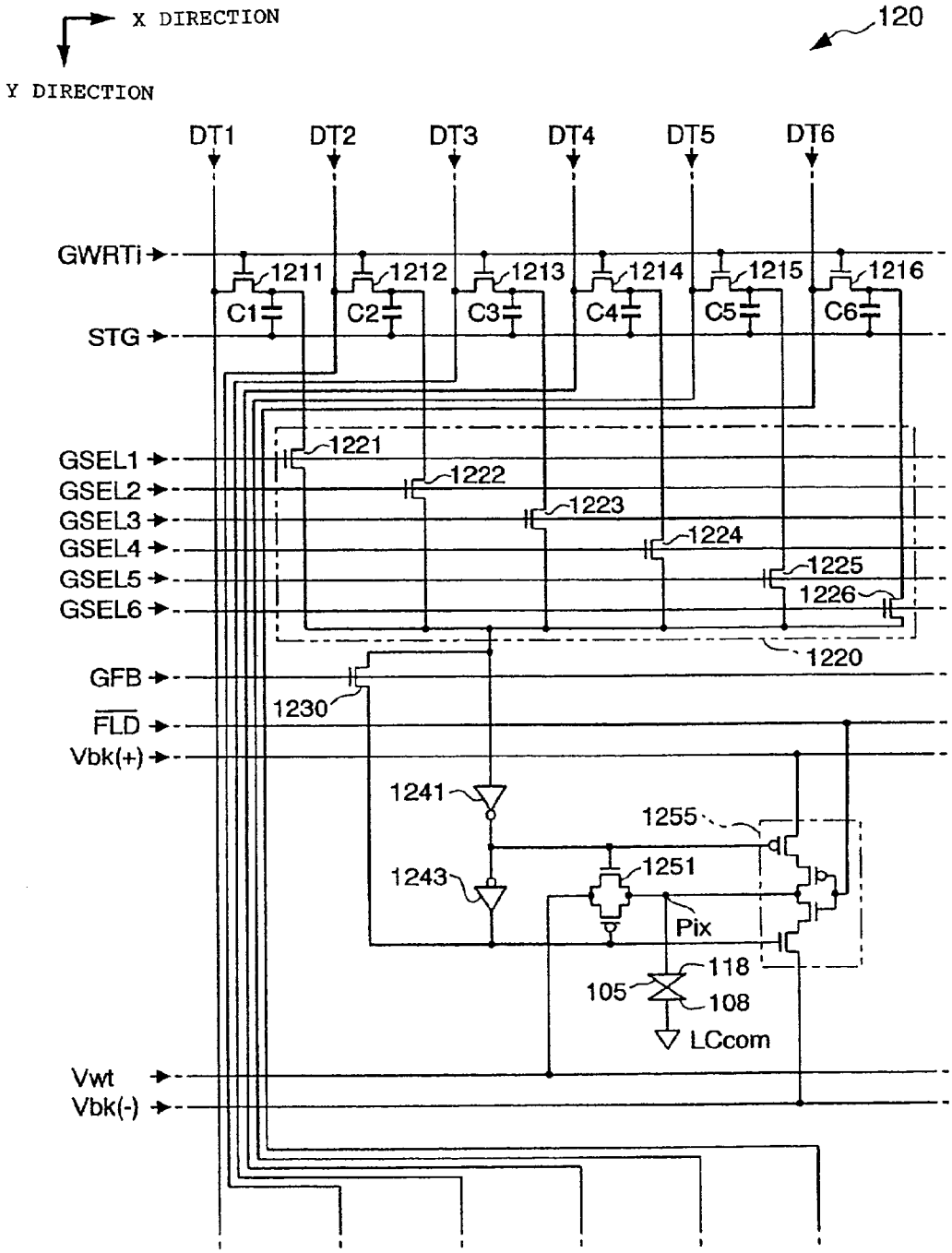

[Fig. 14]
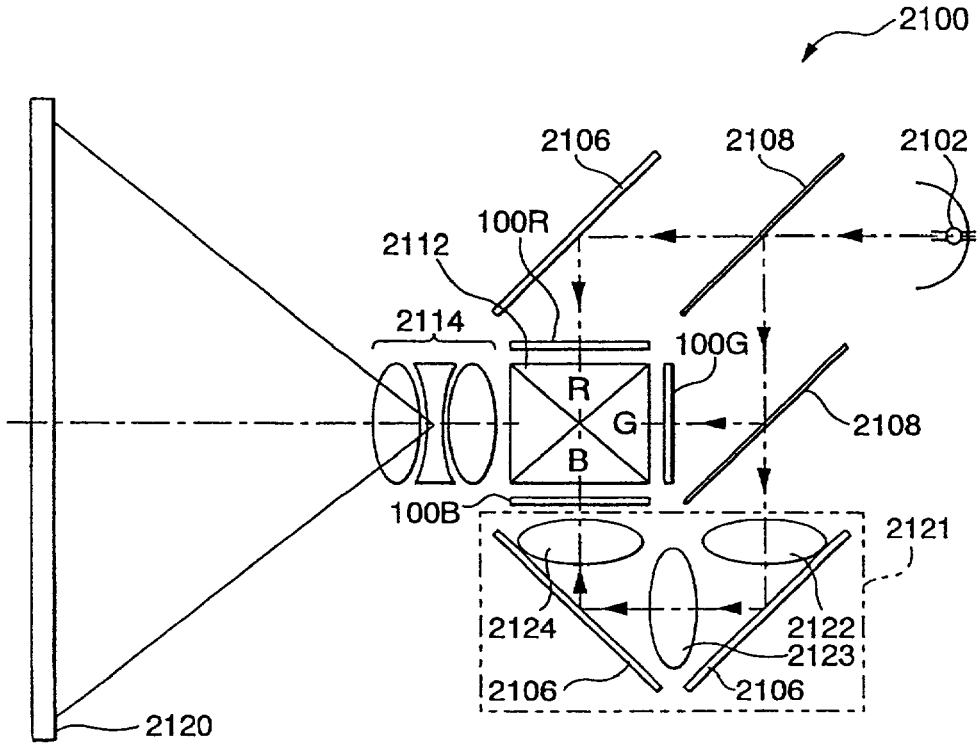

[Fig. 15]
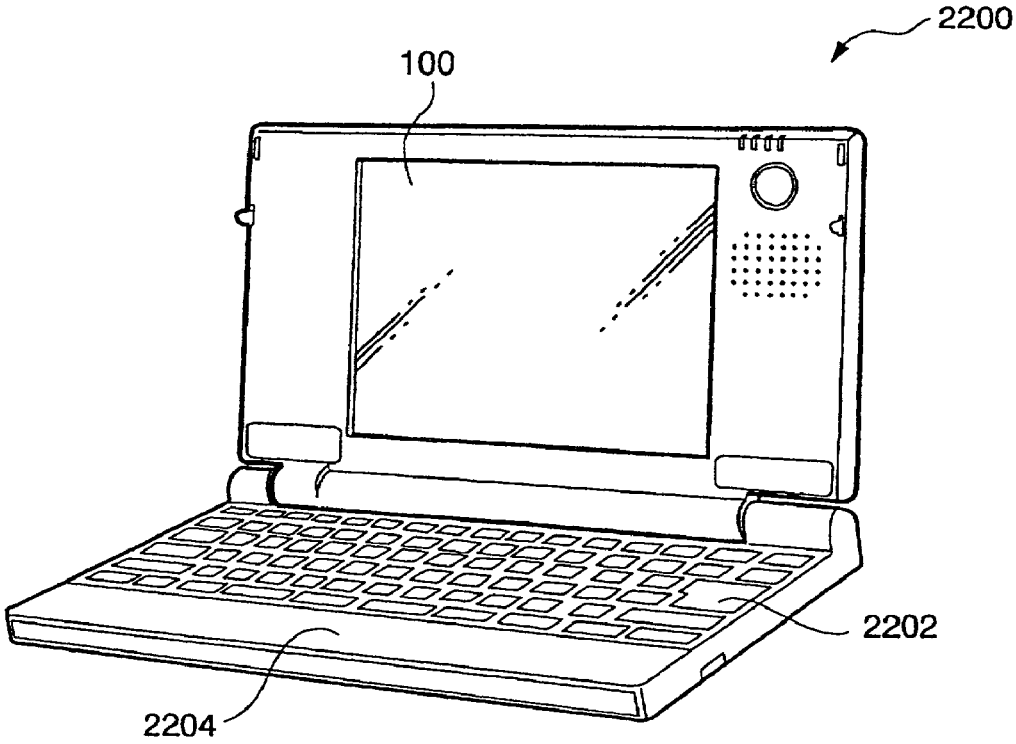

[Fig. 16]
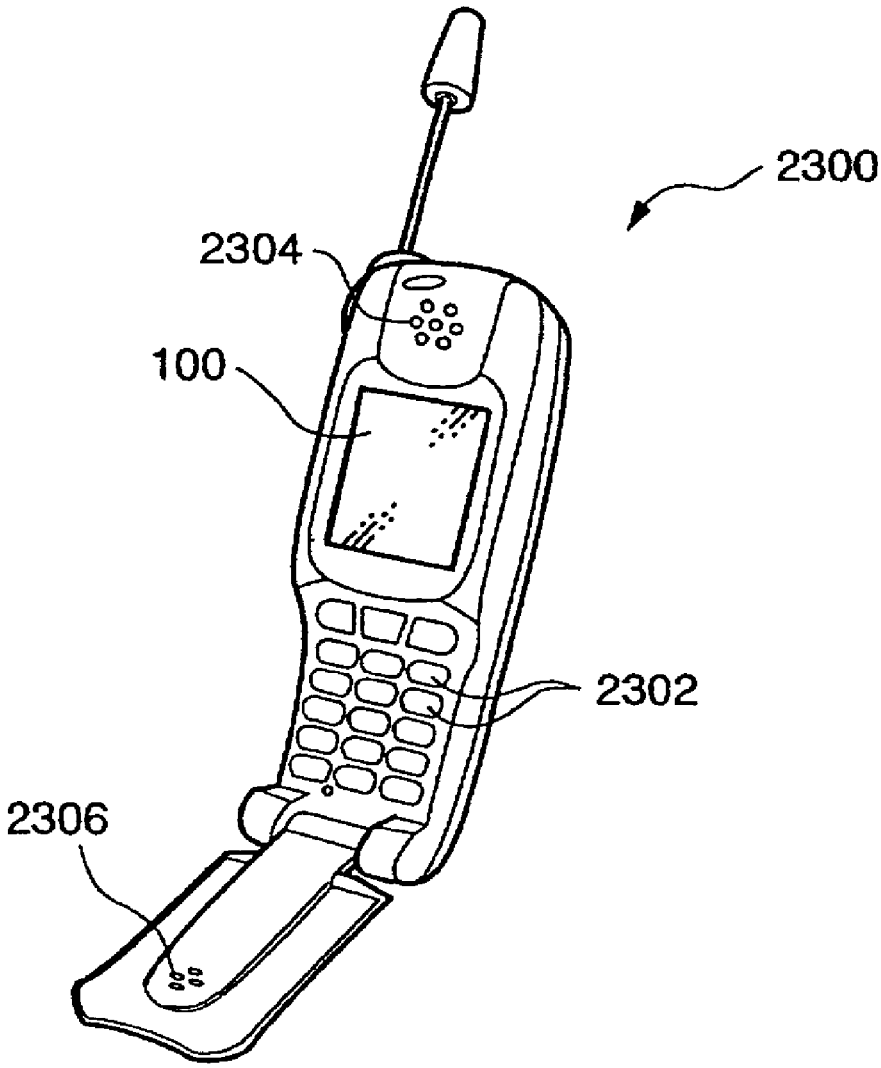

ELECTRO-OPTICAL DEVICE, GRAY SCALE DISPLAY METHOD, AND ELECTRONIC APPARATUS

BACKGROUND OF THE INVENTION

1. Field of Invention

The present invention relates to an electro-optical device enabling a high-quality gray scale display with low power consumption, a gray scale display method therefor, and an electronic apparatus incorporating the electro-optical device.

2. Description of Related Art

Generally, electro-optical devices produce a display by using electro-optical changes of an electro-optical material. A liquid-crystal device using a liquid crystal as an electro-optical material, which is an example of such an electro-optical device, is constructed as described below. The liquid-crystal device includes a component substrate on which pixel electrodes arranged in a matrix, and switching elements connected to these pixel electrodes are provided, an opposing substrate on which opposing electrodes which oppose pixel electrodes are formed, and a liquid crystal as an electro-optical material, which is held between these two substrates.

In such a construction, when the switching element is placed in a conducting state and a voltage signal corresponding to the gray shade is applied to the pixel electrode, a charge corresponding to the voltage signal is stored in the liquid-crystal capacitor in which a liquid crystal is held by the pixel electrode and the opposing electrode. After the charge is stored, even if the switching element is turned off, the storage of the charge in the liquid-crystal capacitor is maintained by the liquid-crystal capacitor itself, etc. In this manner, when each switching element is driven and the amount of charge to be stored is controlled according to the gray shade, since the orientation state of the liquid crystal is changed, the density is changed for each pixel, making a predetermined gray scale display possible.

However, since the voltage signal to be applied to the pixel electrode is a voltage that corresponds to the gray shade, that is, an analog signal, drawbacks exist, such as the fact that display variations are likely to occur due to nonuniformity of various element characteristics, wiring resistance, etc.

Therefore, in order to eliminate such drawbacks, in recent years, a technology has been proposed, in which one field (frame) is divided according to the bits of the gray scale data, the period of each subfield is set according to the weight of each bit, an ON voltage or an OFF voltage is applied, for each subfield, to the pixel electrode in accordance with the bit corresponding to the subfield. Thus, when one field is viewed as one cycle, the effective value of the voltage applied to the liquid-crystal capacitor is controlled to a value that corresponds to the application of the ON voltage or the OFF voltage in each subfield in order to produce a gray scale display. According to such a method, since a signal to be supplied to the wiring only needs to be a binary signal which indicates either ON or OFF of the pixel, problems arising from the nonuniformity of various element characteristics, wiring resistance, etc., can be eliminated or at least reduced.

However, in such a method, a signal indicating ON or OFF of the pixel must be supplied for each subfield in which one field is divided into a plurality of fields. That is, it is necessary to supply a signal indicating ON or OFF of the pixel at a frequency higher than that of the construction in which one field is not divided into subfields, thereby presenting the problem that power consumption is increased.

SUMMARY OF THE INVENTION

The present invention is made in view of the above-described circumstances. An object of the present invention is to provide an electro-optical device which enables a high-quality gray scale display with low power consumption, in which the occurrence of display variations arising from the nonuniformity of various element characteristics, wiring resistance, etc., is reduced, a gray scale display method therefor, and an electronic apparatus that incorporates the electro-optical apparatus.

To achieve the above-mentioned object, in a first aspect, the present invention provides a gray scale display method that provides memories that respectively store each bit of gray scale data which indicates gray shade and that causes pixels arranged in a matrix in the row direction and in the column direction to produce a gray scale display. The gray scale display method includes the steps of: dividing one field into subfields corresponding to bits of the gray scale data; setting the period of each subfield in such a manner as to correspond to the weight of each of the bits; in one subfield and with respect to one pixel, reading, from the memory, bits corresponding to the subfield within the gray scale data corresponding to the pixel, latching the bits, and producing an ON display or an OFF display according to the bits; and writing the latched bits into the read memory again.

According to this method, since the pixel is made to produce an ON display or an OFF display in accordance with the bits stored in the memory, the need to supply the corresponding bits for each subfield is eliminated. Furthermore, since the bits read from the memory are latched within the pixel and are rewritten into the memory, the stored contents are not destroyed due to reading. Therefore, if there are no changes in the display contents, the supply of gray scale data becomes unnecessary, making it possible to simplify the writing operation and to reduce the power consumption associated with the rewriting correspondingly. In the present invention, "one field" represents a period required to form one raster image by performing horizontal scanning and vertical scanning. Therefore, it should be noted that one frame in the non-interlace method also corresponds to one field.

Next, to achieve the above-mentioned object, in a second aspect, the present invention provides an electro-optical device which has pixels arranged in a matrix in the row direction and in the column direction; which divides one field into subfields corresponding to bits of the gray scale data; which sets the period of each subfield in such a manner as to correspond to the weight of each of the bits; and which causes, for each subfield, each of the pixels to produce an ON display or an OFF display according to the corresponding bits within the gray scale data. The electro-optical device includes: for each of the pixels, memories that store each bit of the gray scale data; a selector that selects a memory that stores bits corresponding to a subfield from among the memories; a latch circuit that reads and latches bits stored in the memory selected by the selector, and that rewrites in the memory selected by the selector; an on/off selection switch that selects a voltage corresponding to an ON display or an OFF display in accordance with the bit read from the memory selected by the selector; and a pixel electrode to which the voltage selected by the on/off selection switch is applied.

According to this construction, since a voltage corresponding to ON or OFF is applied to the pixel electrode in accordance with the bits stored in the memory, there is no need to supply the corresponding bits for each subfield. Furthermore, since the bits read from the memory are latched by the latch circuit within the pixel and are rewritten into the memory, the stored contents are not destroyed due to reading. Therefore, if there are no changes in the display contents, the supply of the gray scale data becomes unnecessary, making it possible to simplify the writing operation and to reduce the power consumption associated with the rewriting correspondingly.

Here, in the second aspect of the present invention, preferably, the memory includes a first transfer switch that transfers the bits of the gray scale data when a writing control signal indicating a bit writing timing switches to an active level; and a holding element that holds a voltage corresponding to the bits transferred by the transfer switch. According to this construction, since the memory has a DRAM (Dynamic Random Access Memory) structure, the construction can be simplified.

Meanwhile, in the second aspect of the present invention, preferably, the electro-optical device further includes a rewriting prohibition switch that prohibits rewriting into a memory until the latch circuit reads the bits stored in the memory selected by the selector and latches the bits. According to this construction, since a contention between reading and rewriting of bits is prevented, bit garbling is prevented.

In the second aspect of the present invention, preferably, the electro-optical device includes a second transfer switch that transfers a writing permission signal which permits rewriting when a writing control signal indicating a bit writing timing switches to an active level. The memory only writes the bits of the gray scale data when the writing permission signal transferred by the second transfer switch is at an active level. According to this construction, when the writing control signal is shared among a large number of pixels, even if the writing control signal switches to an active level, if the writing permission signal is not at an active level, writing into the memory is not performed. That is, therefore, only when both the writing control signal and the writing permission signal switch to an active level, writing into the memory is performed. As a consequence, since unnecessary writing into memories is prevented, power consumption can be reduced correspondingly.

Meanwhile, in the second aspect of the present invention, the selection by the on/off selection switch is preferably performed simultaneously in all of the pixels in each subfield, and, more preferably, the selection by the on/off selection switch is performed sequentially for each row in each subfield. That is, in the construction in which an operation in which the voltage selected by the on/off selection switch is applied to the pixel electrode is performed simultaneously, since the number of switches which are operated instantaneously becomes very large, the peak power consumption becomes large, resulting in the construction of the power-supply circuit becoming complex. On the other hand, if the operation in which the voltage selected by the on/off selection switch is applied to the pixel electrode is performed for each row in a line-sequential manner, the number of switches which are operated instantaneously is decreased, and, therefore, the construction of the power-supply circuit is simplified, but the construction for a line-sequential operation might become complex.

Here, for the selector in accordance with the second aspect of the present invention, a first form in which the selector includes switching elements which are interposed between each of the memories and the latch circuit and which are turned on in accordance with a subfield selection signal in which only one of the switching elements exclusively switches to an active level for each subfield, and a second form in which the selector includes a plurality of switching elements which cause only one of paths within the paths between each of the memories and the latch circuit to be exclusively turned on in accordance with data which specifies a subfield are conceivable. Of them, according to the second form of the latter, since the path length between the memory and the latch circuit is shorter than that of the first form, it is possible to decrease the capacitance parasitic to the path. As a consequence, according to the second form, since the amount of charge which is lost by charge sharing when the bits of the gray scale data are transferred from the memory to the latch circuit, the bits can more reliably be transferred correspondingly.

In the second aspect of the present invention, preferably, the electro-optical device includes an opposing electrode which opposes the pixel electrode via an electro-optical material. A voltage corresponding to the OFF display is made to be substantially the same as the applied voltage of the opposing electrode, whereas a voltage corresponding to the ON display is inverted with respect to the voltage corresponding to the OFF display and is supplied for one or more fields. According to this construction, since the electro-optical material is AC-driven, it is possible to prevent DC components from being applied.

Such AC driving is also possible by the following construction. That is, in the second aspect of the present invention, it is also possible to prevent DC components from being applied to the electro-optical material by the construction in which the electro-optical device includes an opposing electrode which opposes the pixel electrode via an electro-optical material. A voltage corresponding to the OFF display is made to be substantially the same as the applied voltage of the opposing electrode, whereas the on/off selection switch alternately selects a positive-polarity-side voltage and a negative-polarity-side voltage, in which the voltage differences with respect to the voltage corresponding to the OFF display are nearly equal, for one or more fields in accordance with a polarity signal indicating a writing polarity when the voltage corresponding to the ON display is selected.

Furthermore, when an electronic apparatus includes the above-described electro-optical device, a high-quality display in which the occurrence of display variations is reduced becomes possible with low power consumption.

BRIEF DESCRIPTION OF THE DRAWINGS

FIG. 1(*a*) is a perspective view showing the exterior of an electro-optical device according to a first embodiment of the present invention, and FIG. 1(*b*) is a sectional view taken along plane A–A' of FIG. 1(*a*);

FIG. 2 is a block diagram showing the electrical configuration of the electro-optical device;

FIG. 3 is a circuit diagram showing the electrical configuration for one pixel in the electro-optical device;

FIG. 4 is a plan view showing the configuration for one pixel in the electro-optical device;

FIG. 5 is a circuit diagram of an equivalent circuit of the configuration shown in FIG. 4;

FIG. 6 is a timing chart illustrating the data writing operation in the electro-optical device;

FIG. 7 is a timing chart illustrating a display refresh operation in the electro-optical device;

FIG. 8 is a block diagram showing the electrical configuration of an electro-optical device according to a second embodiment of the present invention;

FIG. 9 is a circuit diagram showing the electrical configuration for one pixel in the electro-optical device;

FIG. 10 is a timing chart illustrating a data writing operation in the electro-optical device;

FIG. 11 is a timing chart illustrating a display refresh operation in the electro-optical device;

FIG. 12 is a circuit diagram showing another configuration of a selector in a pixel of the electro-optical device according to the embodiment;

FIG. 13 is a circuit diagram showing another configuration of a selector in a pixel of the electro-optical device according to the embodiment;

FIG. 14 is a schematic that shows the construction of a projector, which is an example of an electronic apparatus to which the electro-optical device according to the embodiment is applied;

FIG. 15 is a perspective view showing the construction of a personal computer, which is an example of an electronic apparatus to which the electro-optical device according to the embodiment is applied;

FIG. 16 is a perspective view showing the construction of a portable phone, which is an example of an electronic apparatus to which the electro-optical device according to the embodiment is applied.

DETAILED DESCRIPTION OF PREFERRED EMBODIMENTS

The embodiments of the present invention will now be described below with reference to the drawings.

<1: First Embodiment>

First, an electro-optical device according to a first embodiment of the present invention will be described. This electro-optical device is a transmission-type liquid-crystal display device, in which a liquid crystal is used as an electro-optical material, that produces a predetermined color display by electro-optical changes thereof.

<1-1: Overall Construction>

First, the overall construction of this electro-optical device will be described with reference to FIGS. 1(*a*) and 1(*b*). FIG. 1(*a*) is a perspective view showing the construction of this electro-optical device. FIG. 1(*b*) is a sectional view taken along plane A–A' in FIG. 1(*a*).

As shown in FIGS. 1(*a*) and 1(*b*), an electro-optical device 100 is constructed in such a way that a component substrate 101 on which various components, a pixel electrode 118, etc., are formed, and an opposing substrate 102 on which an opposing electrode 108, etc., are formed are laminated together with a predetermined spacing by a sealing material 104 containing a spacer 103 in such a manner that their electrode-formed sides oppose each other. An electro-optical material, for example, a TN (Twisted Nematic)-type liquid crystal 105, is sealed in this spacing.

For the component substrate 101, in this embodiment, glass, semiconductors, quartz, etc., is used. However, a nontransparent substrate may also be used. When a nontransparent substrate is used for the component substrate 101, it is necessary to use the substrate as a reflection-type rather than as a transmission type. Also, the sealing material 104 is formed around the perimeter of the opposing substrate 102, and a portion thereof is opened so that the liquid crystal 105 is sealed in. For this reason, after the liquid crystal 105 is sealed in, the opened portion is sealed in by a sealing material 106.

Next, in an area 150*a*, which is on an opposing side of the component substrate 101, and which is positioned on one side of the outside of the sealing material 104, a circuit that supplies gray scale data in the row direction is formed, as will be described below. Furthermore, in the outer peripheral portion of this one side, a plurality of mounting terminals 107 are formed, so that various signals are input from an external circuit.

In each of the areas 130*a* positioned at two sides adjacent to this one side, a circuit that outputs a writing control signal, a signal that specifies a subfield, etc., is formed, so that the signal is supplied to the pixel from both sides in the row direction. If the delay of various signals supplied in the row direction does not become a problem, the construction may be formed in such a way that a circuit that outputs these signals is formed in only the area 130*a* of one side. In the remaining one side, a wiring (not shown) shared between circuits formed in the two areas 130*a* is provided.

On the other hand, the opposing electrode 108 that is provided on the opposing substrate 102 is constructed in such a way that the opposing electrode 108 is electrically connected to the mounting terminals 107 formed on the component substrate 101 by a conducting material, such as silver paste, provided in at least one portion of the four corners in the portion where the opposing electrode 108 is laminated with the component substrate 101, and that a voltage LCcom is applied.

In addition, although not particularly shown, the opposing substrate 102 is provided with a coloring layer (color filter) in an area opposing the pixel electrode 118 as necessary. However, when the application is made for the purpose of color light modulation as in a projector (to be described later), there is no need to form a coloring layer on the opposing substrate 102. Irrespective of whether or not a coloring layer is provided, in order to prevent a decrease of the contrast ratio due to the leakage of light, a light-shielding film (not shown) is provided in portions other than the area opposing the pixel electrode 118.

Also, an alignment film undergoing a rubbing process is provided in the opposing side of the component substrate 101 and the opposing substrate 102 so that the direction of the major axis of molecules in the liquid crystal 105 is twisted continuously by approximately 90 degrees between two substrates, whereas a polarizer whose absorption axis is set in the direction along the orientation direction is provided in each rear side thereof. As a result, if the effective value of the voltage applied to the liquid-crystal capacitor (the capacitor comprising the liquid crystal 105 held between the pixel electrode 118 and the opposing electrode 108) is zero, the transmittance reaches its maximum, whereas the transmittance is decreased gradually as the effective voltage value becomes larger, and eventually the transmittance reaches its minimum (normally white mode).

Since the alignment film and the polarizer are not directly related to the present invention, the illustrations thereof are omitted. In FIG. 1(*b*), although the opposing electrode 108, the pixel electrode 118, and the mounting terminals 107 appear to be thick, this is a measure for the sake of convenience in order to show positional relationships, and in practice, they are thin to such a degree that the thickness can be ignored with respect to the thickness of the substrate.

<1-2: Electrical Configuration>

Next, the electrical configuration of the electro-optical device according to this embodiment will now be described. FIG. 2 is a block diagram showing this electrical configuration.

As shown in FIG. 2, pixels 120 of R (red), G (green), and B (blue) are arranged in a matrix in the X (row) direction and in the Y (column) direction. Of these pixels, three RGBRGB pixels (sometimes also called "subpixels") 120 which are adjacent to each other in the column direction form one dot (sometimes also called a "pixel") nearly in the shape of a square. The resolution of this electro-optical device is assumed to be vertical m dots×horizontal n dots for the sake of convenience of description. It is also assumed in this electro-optical device that the pixel 120 of one color produces a display of 64 ($=2^6$) gray shades in accordance with 6-bit gray scale data. As a consequence, in this electro-optical device, when one dot is viewed, a color display of 260,000($=2^{6\times3}$) colors is produced.

Each of the pixels 120 is provided in such a manner as to correspond to the intersecting portion of various signal lines formed in the row direction and in the column direction. Accordingly, next, the various signals supplied to these signal lines will be described below.

Initially, a signal supplied to the signal lines which extend in the row direction is described.

Firstly, writing control signals GWRT1, GWRT2, . . . , GWRTm are such that a transfer start pulse Ysp supplied at the start of the vertical scanning period is sequentially shifted at the rise and fall of a clock signal Yclk by a shift register (SR) 130 provided for each row, as shown in FIG. 6.

Secondly, subfield selection signals GSEL1 to GSEL6 are such that data sfc indicating the subfield at the current time is decoded by a decoder (sf-D) 132 and are such that, as shown in FIG. 7, one of them exclusively switches to a high level according to the subfield at that time. Then, in this embodiment, the subfield selection signals GSEL1 to GSEL6 are commonly supplied for each row.

Here, the "subfield" is such that, as shown in FIG. 7, one field (frame) is divided into "6" portions, "6" being the number of bits of the gray scale data, and is set to the period corresponding to the weight of the bits of the gray scale data. That is, subfields sf6, sf5, sf4, sf3, sf2, and sf1 correspond to the highest-order bit, the second-order bit, the third-order bit, the fourth-order bit, the fifth-order bit, and the lowest-order bit, respectively.

Therefore, if the subfield at the current time is, for example, the subfield sf3 corresponding to the third-order bit of the gray scale data, only the subfield selection signal GSEL3 switches to an H level, and the other subfield selection signals GSEL1, GSEL2, and GSEL4 to GSEL6 switch to an L level.

Thirdly, a switching control signal GFB is a signal which is commonly supplied for each row, and which switches to an L level only at the start timing of the subfields sf1 to sf6, as shown in, for example, FIG. 7.

Fourthly, a constant-potential signal STG is a signal supplied to a common grounding line of holding elements C1 to C6 (see FIG. 3) (to be described below), and is a signal of a constant potential with respect to time.

Fifthly, an OFF display signal Vwt is a voltage signal of a constant potential with respect to time, such that when this signal is applied to the pixel electrode 118 in the pixel 120, the pixel 120 produces an OFF display. As described above, in this embodiment, if the effective value of the voltage applied to the liquid-crystal capacitor in a particular pixel is zero, the pixel produces an OFF display of the maximum transmittance. Therefore, the voltage of the OFF display signal Vwt is in a relationship substantially equal to the voltage LCcom applied to the opposing electrode 108.

Sixthly, Vdd and Vss are a high-potential-side potential Vdd of the power supply and a low-potential-side potential Vss, respectively. Since Vdd and Vss are used as power-supply potentials of an inverter in the pixel 120 (to be described below), they are commonly supplied for each row.

Seventhly, an ON display signal Vbk is a signal of a voltage such that the pixel 120 produces an ON display of the minimum transmittance when this signal is applied to the pixel electrode 118 in the pixel 120. This ON display signal Vbk is such that an ON display signal Vbk (+) on the higher potential side than the OFF display signal Vwt and an ON display signal Vbk (−) on the lower potential side, the difference of the voltages thereof with respect to the OFF display signal Vwt being equal to each other, are selected alternately for each field, by a Vbk selector 134 in FIG. 2, at the start timing of one field, as shown in FIG. 7. That is, the Vbk selector 134 selects one of the ON display signal Vbk (+) on the higher potential side and the ON display signal Vbk (−) on the lower potential side in accordance with a signal FLD whose level is inverted for each field, and outputs the signal as the ON display signal Vbk.

Next, a signal which is supplied to the signal lines which extend in the column direction is described. Since bits DT1 to DT6 of the gray scale data are supplied to the pixel 120 with respect to the column direction, the configuration therefor is described in detail.

First, in FIG. 2, a shift register (SR) 150, which is provided every three columns which form one dot, sequentially shifts a transfer start pulse Xsp which is supplied at the start of the horizontal scanning period at the rise and fall of a clock signal Xclk so that these are output as sampling signals Xsl, Xs2, . . . , Xsn. Here, as shown in FIG. 6, the sampling signals Xsl, Xs2, . . . , Xsn are output in such a way that the pulse widths thereof do not overlap with each other.

On the output side of the shift register 150, a switch 152 corresponding to each of RGBRGB is provided. Generally, when the sampling signal Xsj (j is an integer which satisfies $1 \leqq j \leqq n$) switches to an H level, the three corresponding switches 152 are turned on in order to sample gray scale data DR, DG, and DB, respectively. Here, the gray scale data DR, DG, and DB are 6-bit data indicating the density of the pixels 120 of RGBRGB, respectively, and are externally supplied in sequence at a predetermined timing.

Next, on the output side of the switches 152, a first latch circuit (L) 154 is provided. This first latch circuit 154 latches the gray scale data sampled by the switch 152 corresponding thereto. Furthermore, on the output side of the switches 152, a switch 156 is provided in such a manner as to correspond to each column, so that the gray scale data latched by the first latch circuit 154 is simultaneously sampled in accordance with a latch pulse LP.

Then, the gray scale data sampled by the switch 156 is latched by a second latch circuit (L) 158 provided in such a manner as to correspond to each column, and the bits DT1 to DT6 of this latched gray scale data are in the column direction supplied to the pixel 120.

[39])<1-2-1: Pixel Configuration>

Next, the details of the pixel 120 are described. Here, FIG. 3 is a circuit diagram showing the configuration of a pixel corresponding to one particular color among dots positioned in the i-th row and the j-th column. Letters i and j are used to generally represent the position of a dot formed of the pixels 120 of RGBRGB in a matrix of m rows and n columns, wherein i is an integer which satisfies $1 \leqq i \leqq m$, and j is an integer which satisfies $1 \leqq j \leqq n$.

In the pixel 120, a memory (DRAM) formed of a first transfer switch and a holding element is each provided in the intersecting portion of a signal line to which a writing control signal GWRTi corresponding to the i-th row is supplied, and a signal line to which the bits DT1 to DT6 of the gray scale data corresponding to one color in consideration among the dots of the j-th column is supplied.

More specifically, in the intersecting portion of a signal line to which a writing control signal GWRTi is supplied and a signal line to which the bit DT1 of the gray scale data is supplied, an n-channel type thin-film transistor (hereinafter referred to as a "TFT") 1211 as a first transfer switch is provided. The gate thereof is connected to the signal line to which the writing control signal GWRTi is supplied, the source thereof is connected to the signal line to which the bit DT1 of the gray scale data is supplied, and the drain thereof is connected to one end of the holding element C1. In a similar manner, in the intersecting portions of the signal line to which the writing control signal GWRTi is supplied and the signal line to which the bits DT2 to DT6 of the gray scale data are supplied, TFTs 1212 to 1216 are provided. The gates thereof are connected to the signal lines to which the writing control signal GWRTi is supplied, respectively, the sources thereof are connected to the signal lines to which the bits DT2 to DT6 of the gray scale data are supplied, and the drains thereof are connected to one end of each of the holding elements C2 to C6, respectively. The other ends of the holding elements C1 to C6 are commonly connected to the grounding line to which a constant potential signal STG is applied.

That is, when the writing control signal GWRTi switches to an H level, the TFTs 1211 to 1216 are turned on, and the charge (voltage) corresponding to the bits DT1 to DT6 of the gray scale data, respectively, is charged in the holding elements C1 to C6, respectively. Therefore, even if the writing control signal GWRTi switches to an L level and the TFTs 1211 to 1216 are turned off, the voltages corresponding to the bits DT1 to DT6 continue to be held at one end of each of the holding elements C1 to C6, which thus function as one type of memory.

Next, one end of the holding element C1 is connected to a node A via the n-channel type TFT 1211 as a switch which is turned on when a subfield selection signal GSEL1 switches to an H level. In a similar manner, one end of each of the holding elements C2 to C6 is connected commonly to the node A via the TFTs 1212 to 1216 which are turned on when the subfield selection signals GSEL2 to GSEL6 switch to an H level, respectively.

Therefore, since only those of the TFTs 1211 to 1216 that correspond to the subfield at the current time are turned on, this functions as a selector 1220 which selects only one of the holding elements C1 to C6 that correspond to the subfield.

The node A is connected to the input end of an inverter 1241, and furthermore, the output end thereof is connected to the input end of an inverter 1243. Then, the output end of the inverter 1243 is fed back to the node A via an n-channel type TFT 1230 as a rewriting prohibition switch which is turned on when the switching control signal GFB switches to an H level.

Here, the switching control signal GFB, as described above, is a signal which switches to an L level only at the start timing of the subfields sf5 to sf1 and which switches to an H level in a period other than that. Therefore, since, at the start timing of the subfields sf6 to sf1, the TFT 1230 is turned off, the output of the inverter 1243 is determined without contending with the output contents before that, and immediately after that, the TFT 1230 is turned on. Consequently, as a result of a latch circuit being formed by a closed loop of the inverter 1241, the inverter 1243, and the TFT 1230, the logic level at the node A is maintained at the state determined by the inverter 1243.

Furthermore, the voltage of the logic level maintained at the node A is recharged in the holding elements via the TFTs 1211 to 1216 which are turned on. That is, the contents of the memory, that are read from one of the holding elements C1 to C6 via the selector 1220 at the start timing of the subfields sf6 to sf1, are rewritten into the output state maintained by the ON of the TFT 1230 immediately after that.

On the other hand, the output end of the inverter 1241 is connected to the gate of an n-channel-type TFT, which forms a complementary switch (transmission gate) 1251, and to the gate of a p-channel-type TFT, which forms a complementary switch 1253. Furthermore, the output end of the inverter 1243 is connected to the gate of the p-channel-type TFT, which forms the complementary switch 1251, and to the gate of an n-channel-type TFT, which forms the complementary switch 1253.

Here, the input end of the complementary switch 1251 is connected to the signal line to which an OFF display signal Vwt is supplied, and the input end of the complementary switch 1253 is connected to the signal line to which an ON display signal Vbk is supplied, whereas the output ends of the complementary switches 1251 and 1253 are commonly connected to the pixel electrode 118. As a result, if the node A is at an L level, only the complementary switch 1251 is turned on. Thus the OFF display signal Vwt is applied to the pixel electrode 118. In contrast, if the node A is at an H level, only the complementary switch 1253 is turned on, thus the ON display signal Vbk is applied to the pixel electrode 118.

The pixel electrode 118 is formed of a transparent thin-film metal, such as ITO (Indium Tin Oxide). Also, as described above, a liquid crystal 105 which is an electro-optical material is held between the pixel electrode 118 and the opposing electrode 108 to which the voltage LCcom is applied, thereby forming a liquid-crystal capacitor.

<1-2-2: Practical Pixel Configuration>

Next, the practical configuration of the above-described pixel 120 is described. Here, FIG. 4 is a plan view showing the configuration of the pixel 120 on the opposing side of the component substrate 101. FIG. 5 shows an equivalent circuit of the configuration shown in FIG. 4.

First, in FIG. 4, the lowest layer is a semiconductor layer of, for example, a TFT. Also, the second layer is an conductive layer of, for example, aluminum, and is broadly divided into a gate electrode of a TFT and a signal line formed in such a manner as to extend in the X direction. That is, the portion where the semiconductor layer of the lowest layer and the conductive layer of the second layer intersect becomes a channel region of the TFT. Next, the third layer is, for example, an aluminum layer, and is broadly divided into a wiring for connection to the source and the drain of the TFT and a signal line which is formed so as to extend in the column direction. The connection between wirings formed of mutually different layers, or the connection between the source/drain of the TFT and a wiring, is performed via a contact hole indicated by an "x" mark in FIG. 4.

The holding elements C1 to C6 which form each memory are formed in such a way that the drain region within the semiconductor layer of the TFTs 1211 to 1216 is extended, respectively, below the portion intersecting the signal line to which a constant-potential signal STG is supplied so as to have a low resistance, and that the surface thereof is covered with an insulating film of silicon dioxide, etc. That is, the holding elements C1 to C6 are formed such that the lower-resistance portion of the drain region in the semiconductor layer of each of the TFTs 1211 to 1216 is used as an electrode at one end and the signal line to which the constant-potential signal STG is supplied is used as the electrode at the other end, and that the insulating film is held between the two electrodes.

Here, since the electro-optical device according to this embodiment is a transmission-type liquid-crystal display device as described above, the portion where wiring and semiconductor layers are not formed in FIG. 4 functions as a light-transmission region. In FIG. 4, although the illustration of the pixel electrode 118 positioned in the highest layer within the wiring layer is omitted for the sake of convenience of description, it is connected via a contact hole 1260 that is provided in an output wiring which is common to the complementary switches 1251 and 1253. The inverters 1241 and 1243 in FIG. 3, in practice, are of a complementary configuration in which, as shown in FIG. 4 or 5, a p-channel-type TFT and an n-channel-type TFT are connected in series between the high-potential-side potential Vdd of the power supply and the low-potential-side potential Vss thereof.

The TFT in the pixel 120 is formed by a process which is common to the components of the circuit formed in the area 130*a* and the area 150*a* in FIG. 1. Forming the TFT in this manner is advantageous from the viewpoint of reducing the size and the cost of the entire device in comparison with the electro-optical device of a type in which a peripheral circuit is formed on another substrate and is externally provided.

<1-3: Operation>

Next, the operation of the electro-optical device according to the above-described configuration will be described. This electro-optical device is broadly divided into an operation of writing the bits of the gray scale data to the memory of the pixel 120 and an operation of applying a voltage of the ON display signal Vbk or the OFF display signal Vwt to the pixel electrode 118 in accordance with the bits stored in the memory and of rewriting to the memory. Here, it does not matter if the two operations are synchronized with each other as will be described below, but need not necessarily be synchronized and can be performed independently of each other. Accordingly, the two operations are described below separately.

<1-3-1: Writing Operation>

First, a description is provided of a writing operation of writing the bits of the corresponding gray scale data to each memory in the pixel 120. FIG. 6 is a timing chart illustrating this writing operation.

As shown in FIG. 6, a transfer start pulse Ysp supplied at the start of the vertical scanning period is shifted at the rise and fall of a clock signal Yclk by the shift register 130 (see FIG. 2), and is output as writing control signals GWRT1, GWRT2, . . . , GWRTm which exclusively switch to an H level in each horizontal scanning period 1H. In a period in which any one of the writing control signals GWRT1, GWRT2, . . . , GWRTm switches to an H level, the switching control signal GFB is forcedly placed in an L level (not shown).

Here, when the period in which the writing control signal GWRT1 of the first row switches to an H level is considered, prior to the period, gray scale data DR, DG, and DB corresponding to the dot of the first row and the first column, the dot of the first row and the second column, and the dot of the first row and the nth column are supplied in sequence. At the timing at which the gray scale data DR, DG, and DB corresponding to the dot of the first row and the first column of them are supplied, when the sampling signal Xs1 output from the shift register 150 switches to an H level, the turning-on of the three switches 152 corresponding to the dot of the first column causes the gray scale data to be latched by first three latch circuits 154 similarly corresponding to the dot of the first column, respectively.

Next, at the timing at which the gray scale data DR, DG, and DB corresponding to the dot of the first row and the second column are supplied, when the sampling signal Xs2 switches to an H level, the turning-on of the three switches 152 corresponding to the dot of the second column causes the gray scale data to be latched by first three latch circuits 154 similarly corresponding to the dot of the second column, respectively. Hereinafter, in a similar manner, gray scale data DR, DG, and DB corresponding to the dot of the first row and the nth column are latched by the first three latch circuits 154 corresponding to the dot of the nth column, respectively. As a result, the gray scale data corresponding to n dots positioned in the first row is latched, for each color of RGB, by the first latch circuits 154 corresponding to the first column, the second column, . . . , the nth column, respectively.

Then, when a latch pulse LP is output, the gray scale data latched by the first latch circuits 154 corresponding to the first column, the second column, . . . , the nth column, respectively, is simultaneously latched by second latch circuits 158 when respectively correspond thereto, and is output as the bits DT1 to DT6 for each color of RGB.

Then, since the writing control signal GRTW1 switches to an H level in coincidence with this output timing, in the pixel 120 positioned at the first row, as a result of the TFTs 1211 to 1216 being turned on, the holding elements C1 to C6 are charged with charge (voltage) corresponding to the bits DT1 to DT6, respectively. Hereinafter, the same operation is performed in a line-sequential manner on the pixels 120 positioned in the second row, the third row, . . . , the mth row. As a result, the holding elements C1 to C6 in all the pixels 120 are charged with charge corresponding to the bits DT1 to DT6 of the gray scale data corresponding to the pixel, respectively, and the bits DT1 to DT6 are written into each memory, respectively.

<1-3-2: Display Refresh Operation>

Next, a description is provided of a display refresh operation in which bits corresponding to the subfield at the current time within the bits DT1 to DT6 held in each memory, respectively, of the pixel 120 by the above-described writing operation are read, a voltage corresponding to the bit is applied to the pixel electrode 118, and the bit is rewritten to the read memory. FIG. 7 is a timing chart illustrating this display refresh operation.

Initially, at the start subfield sf6 within one field, only the subfield selection signal GSEL6 switches to an H level. For this reason, in a selector 1220 of each pixel 120, since only a TFT 1216 (see FIG. 3) is turned on, the node A becomes substantially equal to the voltage held at one end of the holding element C6.

Here, at the start timing of the subfield sf6, since the switching control signal GFB switches to an L level, the output of an inverter 1243 switches to the same logic level as that of the node A regardless of the previous output state. Also, if the node A is at an L level, the voltage of the OFF display signal Vwt is applied to the pixel electrode 118 as a result of the turning-on of a complementary switch 1251. In contrast, if the node A is at an H level, the voltage of the ON display signal Vbk is applied thereto as a result of the turning-on of a complementary switch 1253.

Thereafter, when a predetermined time has passed and the switching control signal GFB switches to an H level, the output of the inverter 1243 is fed back to the input of the inverter 1241 which is the node A. Consequently, the logic level of the node A is maintained at the output state determined by the inverter 1243. That is, the output of the inverter 1243 becomes such that the logic level of the node A is latched. Then, the latched logic level is recharged in the holding element C6 via the TFT 1216, whereas the voltage of the OFF display signal Vwt or the ON display signal Vbk is continuously applied to the pixel electrode 118 in accordance with the latched logic level.

Then, at the second subfield sf5 within one field, since only the subfield selection signal GSEL5 switches to an H level, in the selector 1220 of each pixel 120, as a result of only the TFT 1215 is turned on, causing the node A to become nearly equal to the voltage held at one end of the holding element C5. The subsequent operation is completely the same as the operation in the subfield sf6. The voltage of the OFF display signal Vwt or the ON display signal Vbk is applied to the pixel electrode 118 in accordance with the voltage at one end of the holding element C5, that is, the logic level corresponding to the bit DT5, and the holding element C5 is recharged.

Hereinafter, the same operation is simultaneously performed in all the pixels 120 in the subfields sf4, sf3, sf2, and sf1. That is, in the subfields sf4 to sf1, the voltage of the OFF display signal Vwt or the ON display signal Vbk is applied to the pixel electrode 118 of each pixel 120 in accordance with the voltage at one end of each of the holding elements C4 to C1, that is, each of the bits DT4 to DT1, and the holding elements C4 to C1 are recharged.

Therefore, if the effective value of the voltage applied to the liquid-crystal capacitor of one particular pixel 120 becomes such a value that, if one field is seen as one cycle, the voltage of the ON display signal Vbk which is applied for each of the subfields sf6 to sf1 is accumulated with respect to time. Consequently, a gray scale display corresponding to that value is produced.

For example, if the voltages held at one end of each of the holding elements C6 to C1 of a particular pixel 120 are at H, H, L, L, H, and L levels, respectively, as shown in FIG. 7, the ON display signal Vbk is applied to the pixel electrode 118 across the subfields sf6 and sf5, as indicated by Pix in FIG. 7, in the following subfield sf4 and sf3, the OFF display signal Vwt is applied, and in the following subfield sf2, the ON display signal Vbk is applied, and, thereafter, in the subfield sf1, the OFF display signal Vwt is applied. Consequently, since the effective value of the voltage corresponding to the 6-bit gray scale data (110010) is applied to the liquid-crystal capacitor, a gray scale display corresponding to the value is produced. Furthermore, in the next one field, since the voltage selected as the ON display signal Vbk is made to be such that the polarity thereof is inverted by the Vbk selector 134 (see FIG. 2) with respect to the electrical potential of the OFF display signal Vwt, the liquid-crystal capacitor of the pixel 120 is AC-driven in two fields. In FIG. 7, the hatching of the voltage Pix applied to the pixel electrode 118 indicates the voltage-applied period of the ON display signal Vbk.

Immediately after the turning-on of the TFTs 1211 to 1216 in the selector 1220, since the TFT 1230 positioned in the closed loop of the latch circuit is off, the electrical potential at one end of each of the holding elements C1 to C6 slightly drops (increases) by charge sharing during an input to the inverter 1241, as shown in FIG. 7. However, immediately thereafter, as a result of the TFT 1230 being turned on, since the holding element is recharged to the logic level of the output (node A) of the inverter 1243, it returns to the original level.

<1-4: Summary of the First Embodiment>

As described above, according to the electro-optical device of the first embodiment, the voltage of the OFF display signal Vwt or the ON display signal Vbk is applied, for each of the subfields sf6 to sf1, to the pixel electrode 118 in accordance with the bits DT1 to DT6 stored in the memory in each pixel 120. This causes the effective value of the voltage applied to the liquid-crystal capacitor in one field to be controlled and to produce a gray scale display. For this reason, it is not necessary to supply a bit signal indicating ON or OFF of the pixel 120 for each subfield. Furthermore, for each memory in the pixel 120, the memory being formed of DRAM composed of a set of a TFT as a transfer switch and a holding element, in the corresponding subfield, an operation of selecting a voltage to be applied to the pixel electrode 118 and a rewriting (refresh) are performed for each field. Therefore, when a still image is to be displayed, if, first, the gray scale data corresponding to the still image is written to the memory in each pixel 120, hereafter, there is no need to perform a writing operation, making it possible to reduce the power consumption caused by writing.

The first embodiment is formed such that the ON display signal Vbk to be supplied to each row is made common. However, in this configuration, since the writing polarity is the same in all the pixels 120, there is a possibility that so-called flicker occurs. Therefore, in practice, it is preferable that the Vbk selectors 134 be divided for odd numbers and even numbers, the Vbk selectors 134 for odd numbers and even numbers output ON display signals Vbk having mutually opposite polarities, and the Vbk selector be provided for each row.

<2: Second Embodiment>

In the above-described first embodiment, in the writing operation, generally, when the writing control signal GWRTi generally corresponding to the i-th row switches to an H level, all the TFTs 1211 to 1216 in the pixel 120 positioned in the i-th row are turned on. That is, when the writing control signal GWRTi switches to an H level, the TFTs 1211 to 1216 of the pixel 120 in which there is no need to change the display contents are turned on. As a consequence, in this respect, a wasteful writing operation occurs.

Furthermore, in the above-described first embodiment, since the display refresh operation is simultaneously performed in each pixel 120 for each of the subfields sf6 to sf1, the number of elements which are switched at the same time becomes very large. For this reason, since the peak value of the power consumption becomes large, in the electro-optical device according to the first embodiment, there is a tendency that the driving load of the power-supply circuit is increased and the power consumption becomes large.

Accordingly, a description is provided of the second embodiment in which gray scale data is selectively supplied to only the dot for which the memory contents must be changed, and the power-supply circuit is prevented from becoming complex. Since the overall construction of the electro-optical device according to this second embodiment is the same as that of the first embodiment shown in FIG. 1, the description thereof is omitted, and a description is provided starting from the electrical configuration.

<2-1: Electrical Configuration>

FIG. 8 is a block diagram showing the electrical configuration of the electro-optical device according to the second embodiment of the present invention. In this second embodiment, the description focuses on the differences with the first embodiment shown in FIG. 2, and descriptions of common details are omitted.

In the second embodiment, the gray scale data DR, DG, and DB are not supplied in sequence with respect to all the pixels 120 as in the first embodiment. Instead, only the gray scale data corresponding to the dot whose display contents are to be changed is specified by a row address yAD and a column address xAD and is supplied.

For this reason, as shown in FIG. 8, a row address decoder (yAd-D) 140 is provided for each row of the dot, whereas a column address decoder (xAd-D) 160 is provided for each column of the dot. The row address decoder 140, which generally corresponds to the i-th row of them, outputs a writing control signal GWRTi which switches to an H level if the row address yAD indicates the i-th row. That is, in the second embodiment, the writing control signal GWRTi is not output from the shift register 130 corresponding to the i-th row, but, is output from the row address decoder 140 corresponding to the i-th row.

On the other hand, in this embodiment, the decoder (sf-D) 132 and the Vbk selector 134 are provided for each row. The decoder 132, which generally corresponds to the i-th row of them, decodes the data sfc sampled by a switch 142 and outputs the subfield selection signals GSEL1 to GSEL6 corresponding to the subfield to the corresponding row.

Also, the Vbk selector 134 corresponding to the i-th row selects the ON display signal Vbk in accordance with the logic level of the signal FLD sampled by a switch 144. More specifically, if the sampled signal FLD is at an H level, the Vbk selector 134 corresponding to the i-th row selects one of the ON display signal Vbk (+) on the higher potential side and the ON display signal Vbk (−) on the lower potential side, and if the sampled signal FLD is at an L level, the Vbk selector 134 selects the other signal. However, the Vbk selector 134 corresponding to the (i−1) row and the (i+1) row adjacent to the i-th row selects the other of the ON display signal Vbk (+) on the higher potential side and the ON display signal Vbk (−) on the lower potential side when the sampled signal FLD is at an H level, and selects the other one if the sampled signal FLD is at an L level. That is, the polarities of the ON display signals Vbk selected by the Vbk selectors 134 corresponding to the adjacent rows are set in such a way that they are inverted with respect to each other.

Both the switches 142 and 144 are turned on when a transfer signal Ysi by the shift register 130 corresponding to the i-th row switches to an H level. The former switch 142 samples the data sfc indicating the subfield at the current time, whereas the latter switch 144 samples the signal FLD which serves as a reference when the ON display signal is selected.

Also, in this second embodiment, an AND gate 146 is provided for each row. Here, the AND gate 146, which generally corresponds to the i-th row, outputs, to the corresponding i-th row, an AND signal of the transfer signal Ysi by the shift register 130, which similarly corresponds to the i-th row and a control signal FB, as a switching control signal GFB. Here, as shown in FIG. 11, the control signal FB is a signal which instantaneously switches to an L level at the rise and fall of the clock signal Yclk, which is the output period of the transfer switches Ys1, Ys2, . . . , Ysm by the shift register 130.

Next, the column address decoder 160 generally corresponding to the j-th column of the dot outputs a sampling signal Xsj which switches to an H level if the column address xAD indicates the corresponding j-th column. That is, in the second embodiment, the sampling signal Xsj is not output from the shift register 150 (see FIG. 2) as in the first embodiment, but, is output from the column address decoder 160 corresponding to the j-th column.

Also, in this embodiment, a flip-flop (FF) 162 is provided for each column of the dot. Here, a signal ffj output from the flip-flop 162 generally corresponding to the j-th column is such that the sampling signal Xsj which is output in such a manner as to similarly correspond to the j-th column is set and is reset to an L level in accordance with a reset signal RST.

Furthermore, in this embodiment, the AND gate 164 is provided for each column of the dot. Here, the AND gate 164 generally corresponding to the j-th column outputs an AND signal of the signal ffj which is output in such a manner as to similarly correspond to the j-th column and a control signal TRS. In this embodiment, when the AND signal is at an H level, the three switches 156, provided in such a manner as to correspond to the dot of the j-th column, are turned on.

On the other hand, the signal ffj, output in such a manner as to correspond to the j-th column, is sampled by a switch 166 which is turned on when the control signal TRS is at an H level. Furthermore, the signal ffj sampled by the switch 166 is latched by a third latch circuit (L) 168, and this latched signal is supplied, as a writing permission signal DTWj, to the dot of the j-th column. That is, in this embodiment, the writing permission signal DTWj is supplied at intervals of three columns (for each column of the dot) of the pixel 120 of RGB.

<2-1-1: Pixel Configuration>

Next, the details of the pixel 120 in this second embodiment are described. Here, FIG. 9 is a circuit diagram showing the configuration of the pixel 120 corresponding to R (Red) within the dot positioned at the i-th row and the j-th column.

As shown in FIG. 9, in a manner similar to the first embodiment, in the pixel 120 of R in this embodiment, a memory (DRAM) formed of a first transfer switch and a holding element are provided in an intersecting portion of a signal line to which the writing control signal GWRTi corresponding to the i-th row is supplied, and a signal line to which the bits DT1 to DT6 of the gray scale data DR corresponding to R are used.

However, in this embodiment, an n-channel-type TFT 1270 as a second transfer switch is provided in an intersecting portion of the signal line to which the writing control signal GWRTi is supplied and the signal line to which the writing permission signal DTWj is supplied. Here, the gate of the TFT 1270 is connected to the signal line to which the writing control signal GWRTi is supplied, the source thereof is connected to the signal line to which the writing permission signal DTWj is supplied, and the drain thereof acts as a common gate of the n-channel-type TFTs 1281 to 1286 as the first transfer switches.

Furthermore, the source of the TFT 1281 is connected to the signal line to which the bit DT1 of the gray scale data is supplied, and the drain thereof is connected to one end of the holding element C1. In a similar manner, the sources of the TFTs 1282 to 1286 are connected to the signal lines to which the bits DT2 to DT6 of the gray scale data are supplied, respectively, and furthermore, the drains thereof are connected to one end of each of the holding elements C2 to C6, respectively. That is, in this embodiment, memories that hold the bits DT1 to DT6 are formed by each set of the TFTs 1281 to 1286 and the holding elements C1 to C6.

The drain of the TFT 1270, that is, the common gate of the TFTs 1281 to 1286, is also common in three pixels 120 of RGB which form the dot of the i-th row and the j-th column (see FIG. 8). The remaining configuration is the same as that of the pixel 120 of the first embodiment shown in FIG. 3.

In the pixel 120 shown in FIG. 9, when the writing control signal GWRTi switches to an H level, the TFT 1270 is turned on, and the writing permission signal DTWj is transferred to the gate of the TFTs 1281 to 1286. At this time, even if the writing control signal GWRTi is at an H level, if the writing permission signal DTWj is at an L level, the TFTs 1281 to 1286 are OFF, and, therefore, charge corresponding to the bits DT1 to DT6 is not charged in the holding elements C1 to C6. In other words, in the pixel 120 in this embodiment, only when both the writing control signal GWRTi and the writing permission signal DTWj reach an H level, in the three pixels 120 of RGB which form the dot of the i-th row and the j-th column, (each bit of) the gray scale data DR, DG, and DB of each color corresponding to the dot are written.

<2-2: Operation>

Next, the operation of the electro-optical device according to the second embodiment is described. Also in this electro-optical device, similarly to the first embodiment, the operation is broadly divided into an operation of writing the bits of the gray scale data into the memories of the pixel 120 and an operation of applying a voltage corresponding to the bits stored in the memory and rewriting the bits to the memory, and the two operations can be performed independently of each other. Accordingly, similarly to the first embodiment, the two operations are described separately.

<2-2-1: Writing Operation>

First, a description is provided of a writing operation of writing the bits of the gray scale data to each memory in each pixel 120, respectively. FIG. 10 is a timing chart illustrating this writing operation.

As shown in FIG. 10, gray scale data DR, DG, and DB, in which a row address yAD is common, are supplied in synchronization with the column address xAD, and, thereafter, the corresponding row address yAD is supplied. At this time, in a period in which the row address yAD corresponding to a particular row is supplied, the column address xAD is supplied after a predetermined blanking period. Furthermore, this blanking period is divided into a first half period and a second half period, and in this first half period, the control signal TRS switches to an H level, whereas, in this second half period, the reset signal RST switches to an H level.

In such a blanking period, when the reset signal RST switches to an H level, all the output signals ff1, ff2, . . . , ffn of the flip-flop 162 provided for each column of the dot are reset to an L level. Thereafter, as shown in FIG. 10, when the gray scale data DR, DG, and DB corresponding to, for example, the dot of the 13th row and the 1st column is supplied in such a way that the column address xAD of "X001" indicating the 1st column, since the column address decoder 160 (see FIG. 8) corresponding to the 1st column decodes the column address xAD. As a result, the sampling signal Xs1 switches to an H level only in the supply period. As a result, the output signal ff1 of the flip-flop 162 corresponding to the 1st column of the dot switches to an H level, whereas the first three latch circuits 154 corresponding to the dot of the 1st column latch the gray scale data DR, DG, and DB, respectively.

Next, when the gray scale data DR, DG, and DB corresponding to the dot of the 13th row and the 2nd column are supplied in synchronization with the column address xAD of "X002" indicating the 2nd column, in a similar manner, the sampling signal Xs2 switches to an H level only in the supply period. As a result, the output signal ff2 of the flip-flop 162 corresponding to the 2nd column switches to an H level, whereas the first three latch circuits 154 corresponding to the dot of the 2nd column latch the gray scale data DR, DG, and DB, respectively.

Hereinafter, in a similar manner, when the gray scale data DR, DG, and DB corresponding to the dot of the 13th row and the 3rd column and the dot of the 13th row and the 4th column are supplied in synchronization with the column addresses xAD of "X003" and "X004", respectively, the sampling signals Xs3 and Xs4 only switch to an H level in the supply period. As a result, each of the output signals ff3 and ff4 switches to an H level, whereas the first three latch circuits 154 corresponding to the dot of the 3rd column latch the gray scale data DR, DG, and DB of the 13th row and the 3rd column, respectively, and the first three latch circuits 154 corresponding to the dot of the 4th column latch the gray scale data DR, DG, and DB of the 13th row and the 4th column, respectively. Here, if there is no other dot whose display contents are changed among the dots positioned at the 13th row, the blanking period is reached, and the row address yAD of "Y013" indicating the 13th row is supplied.

Next, in the first half period of the blanking period, the control signal TRS switches to an H level. At this time, those output signals which have reached an H level among the output signals ff1, ff2, . . . , ffn of the flip-flop 162 are only the output signals ff1 to ff4. For this reason, those writing permission signals which switch to an H level among the writing permission signals DTW1, DTW2, . . . , DTWn latched by the turning-on of the switch 166 are only DTW1 to DTW4, and the other signals switch to an L level. At this time, since only the AND gates 164 corresponding to the dots of the first to fourth columns are turned on, (each of the bits DT1 to DT6 of) the gray scale data DR, DG, and DB of the 13th row and the 1st column to the 13th row and the 4th column are supplied, for each color of RGB, to the 1st to 4th columns, respectively.

On the other hand, since the row address decoder 140 corresponding to the 13th row decodes the row address yAD of "Y013" indicating the 13th row, only the writing permission signal GWRT13 switches to an H level in the supply period.

Therefore, those dots whose memory contents are rewritten as a result of the writing permission signal GWRT13 switching to an H level are only the dots of the 13th row and the 1st column to the 13th row and the 4th column, and the memory contents of the other dots are not rewritten. At this time, in the 5th to nth columns of the dots, the gray scale data which was latched previously is continuously supplied to the pixel 120. Since the writing permission signals DTW5 to DTWn are at an L level, unlike the first embodiment, the stored memory contents are not changed.

Then, in the second half period of the blanking period, since the control signal TRS switches to an L level, all the switches 164 and 166 are turned off, whereas, since the reset signal RST switches to an H level, all the output signals ff1, ff2, . . . , ffn of the flip-flop 162 are reset again to an L level. Thereafter, as shown in, for example, FIG. 10, when the gray scale data DR, DG, and DB, corresponding to the dots of the 58th row and the 3rd column and of the 58th row and the 4th column, are supplied in synchronization with the column addresses xAD of "X003" and "X004", respectively, each of the sampling signals Xs3 and Xs4 switches to an H level in the supply period. As a result, each of the output signals ff3 and ff4 switches to an H level, whereas the first three latch circuits 154 corresponding to the dot of the 3rd column latch the gray scale data DR, DG, and DB of the 58th row and the 3rd column, respectively, and the first three latch circuits 154 corresponding to the dot of the 4th column latch the gray scale data DR, DG, and DB of the 58th row and the 4th column, respectively. Here, if there is no other dot whose display contents are to be changed among the dots positioned at the 58th row, the blanking period is reached, and the row address yAD of "Y058" indicating the 58th row is supplied.

Then, in the first half period of the blanking period, the control signal TRS switches to an H level. At this time, since only the output signals ff3 and ff4 are at an H level, only the writing permission signals DTW3 and DTW4 switch to an H level, and, since only the AND gates 164 corresponding to the dots of the 3rd and 4th columns are turned on, (each of the bits DT1 to DT6 of) of the gray scale data DR, DG, and DB of the 58th row and the 3rd column and of the 58th row and the 4th column are supplied to the 3rd and 4th columns of the dots for each color of RGB, respectively. On the other hand, since the row address decoder 140 corresponding to the 58th row decodes the row address yAD of "Y058" indicating the 58th row, only the writing permission signal GWRT58 switches to an H level in the supply period.

Therefore, since the writing permission signal GWRT58 switches to an H level, the dots whose memory contents are to be changed are only the dots of the 58th row and the 3rd column and of the 58th row and the 4th column, and the memory contents of the other dots are not rewritten. Hereinafter, the same operation is performed on only the dots specified by the column address xAD and the row address yAD.

<2-2-2: Display Refresh Operation>

Next, a description is provided of a display refresh operation in which the bits corresponding to the subfield at the current time among the bits DT1 to DT6 held by each memory of the pixel 120, respectively, by the above-described writing operation are read, the voltage corresponding to the bit is applied to the pixel electrode 118, and the bit is rewritten to the read memory. FIG. 11 is a timing chart illustrating this display refresh operation.

As shown in FIG. 11, in the first subfield sf6 within one field, the transfer start pulse Ysp is shifted by the shift register 130 (see FIG. 8) in accordance with the clock signal Yclk, and is output as transfer signals Ys1, Ys2, . . . , Ysm in such a manner that the pulse widths thereof do not overlap with each other. The transfer start pulse Ysp and the clock signal Yclk are each used during a writing operation in the first embodiment. However, in this embodiment, they are used for a display refresh operation. For this reason, it should be noted that the natures of the transfer start pulse Ysp and the clock signal Yclk are different between the first embodiment and the second embodiment.

When the transfer signal Ys1 switches to an H level, since the switch 142 corresponding to the first row in FIG. 8 is turned on, the data sfc is sampled, and it is decoded by the decoder 132 similarly corresponding to the first row. At this point in time, since the subfield sf6 is reached at this point in time, the decoder 132 corresponding to the first row causes the subfield selection signal GSEL6 to switch to an H level.

Also, when the transfer signal Ys1 switches to an H level, since the switch 144 corresponding to the first row in FIG. 8 is turned on, the signal FLD is sampled, and this is used as the reference for selection in the Vbk selector 134 similarly corresponding to the first row. It is assumed that the Vbk selector 134 corresponding to the first row selects the ON display signal Vbk (−) on the lower potential side in accordance with the sampled signal FLD.

Furthermore, since the control signal FB switches to an L level immediately after the fall of the clock signal Yclk, the AND gate 146 corresponding to the first row is closed. For this reason, the switching control signal GFB corresponding to the first row switches to an L level.

Therefore, in the period in which the transfer signal Ys1 switches to an H level and the control signal FB is at an L level, in the pixel 120 positioned at the first row, the voltage of the ON display signal Vbk or the OFF display signal Vwt is applied to the pixel electrode 118 in accordance with the logic level at one end of the holding element C6 shown in FIG. 9. Immediately after this, when the control signal FB switches to an H level, the AND gate 146 corresponding to the first row is opened, causing the switching control signal GFB corresponding to the first row to switch to an H level. As a result, in the pixel 120 positioned at the first row, the TFT 1230 is turned on. As a result, the logic level of the node A is latched, and the holding element C6 is recharged.

Next, when the transfer signal Ys2 switches to an H level, since the switch 142 corresponding to the second row is turned on, the data sfc is sampled, and this data is decoded by the decoder 132 similarly corresponding to the second row. As a result, the decoder 132 corresponding to the second row causes the subfield selection signal GSEL6 to switch to an H level.

Also, when the transfer signal Ys2 switches to an H level, since the switch 144 corresponding to the second row is turned on, the signal FLD is sampled, and this signal is used as the reference of selection in the Vbk selector 134 similarly corresponding to the second row. Here, the Vbk selector 134 corresponding to the second row is opposite to the Vbk selector 134 corresponding to the first row in the selection reference corresponding to the logic level of the signal FLD. Therefore, the Vbk selector 134 selects the ON display signal Vbk (+) on the higher potential side in accordance with the sampled signal FLD.

Furthermore, since the control signal FB switches to an L level also immediately after the rise of the clock signal Yclk, the AND gate 146 corresponding to the second row is closed. As a result, the switching control signal GFB corresponding to the second row switches to an L level.

Therefore, in the period in which the transfer signal Ys2 switches to an H level and the control signal FB is at an L level, in the pixel 120 positioned at the second row, the voltage of the ON display signal Vbk or the OFF display signal Vwt is applied to the pixel electrode 118 in accordance with the logic level at one end of the holding element C6. When the control signal FB switches to an H level immediately after this, the AND gate 146 corresponding to the second row is opened, causing the switching control signal GFB corresponding to the second row to switch to an H level. As a result, in the pixel 120 positioned at the second row, the TFT 1230 is turned on. As a result, the logic level of the node A is latched, and the holding element C6 is recharged.

Hereinafter, in a similar manner, each time the transfer signals Ys1, Ys2, . . . , Ysm exclusively switch to an H level in sequence, in the pixel 120 positioned at third, fourth, . . . , m-th rows, the operation in which the voltage corresponding to the logic level at one end of the holding element C6 is applied to the pixel electrode 118, and the recharging of the holding element C6 are performed in a line-sequential manner.

Then, the subfield sf5 is reached, and each time the transfer signals Ys1, Ys2, . . . , Ysm switch to an H level in sequence, similarly, in the pixel 120 positioned at first, second, . . . , m-th rows, the operation in which the voltage corresponding to the logic level at one end of the holding element C5 is applied to the pixel electrode 118, and the recharging of the holding element C5 are performed in a line-sequential manner.

Furthermore, also in the subfields sf4 to sf1, similarly, the operation in which the voltage corresponding to the logic level at one end of each of the holding elements C4 to C1 is applied to the pixel electrode 118, and the recharging of each of the holding elements C4 to C1 are performed in a line-sequential manner.

<2-3: Summary of the Second Embodiment>

In the manner described above, in the second embodiment, similarly to the first embodiment, the effective value of the voltage applied to the liquid-crystal capacitor of one particular pixel 120, when one field is viewed as one cycle, becomes a value such that the voltage of the ON display signal Vbk which is applied for each of the subfields sf6 to sf1 is accumulated with respect to time, and therefore, a gray scale display corresponding to the value is produced.

However, in the second embodiment, the operation in which the voltage corresponding to the logic level at one end of each of the holding elements C6 to C1 is applied to the pixel electrode 118, and the recharging of each of the holding elements C6 to C1 are performed in a line-sequential manner, rather than simultaneously (in a plane-sequential manner) as in the first embodiment. Therefore, since the number of elements which are switched simultaneously in response to these operations is decreased in comparison with the first embodiment (note: in the first and second embodiments, the numbers of elements which are switched per unit time are the same), the peak value of the power consumption is decreased. As a result, it becomes possible to prevent the power-supply circuit from becoming complex. However, when compared to the first embodiment, since the decoder 132 and the Vbk selector 134 are provided for each row, the construction for a line-sequential operation becomes complex.

Although in the above-described second embodiment, the writing operation and the display refresh operation are performed independently of each other, both operations may be performed in synchronization with each other. Here, when the writing operation and the display refresh operation are performed in synchronization with each other, the timing at which the control signal is made to switch to an H level in the writing operation, and the timing at which the control signal FB is made to switch to an L level in the display refresh operation may be made coincident with each other. When such a configuration is adopted, since the TFT 1230 (see FIG. 9) is OFF when the bits DT1 to DT6 are written, bit garbling can be prevented.

<3: Applications and Modifications>

In the above-described first and second embodiments, various applications and modifications are possible. The selector 1220 in the pixel 120 and the configuration for Ac-driving the liquid-crystal capacitor can be modified. Exemplary modifications are discussed below.

<3-1: Another Example of Selector>

First, although in the above-described first and second embodiments, the data sfc indicating the subfield at the current time is decoded by the decoder 132 and is supplied, as the subfield selection signals GSEL1 to GSEL6, to the pixel 120, the data sfc may be supplied in the row direction to the pixel 120, so that the data sfc is decoded by each pixel 120.

In this configuration, in the selector 1220, a switching element (for example, a TFT) which is turned on/off in accordance with each bit of the data sfc may be disposed so that only the path corresponding to the subfield indicated by the data sfc among paths which connect one end of each of the holding elements C1 to C6 and the node A is turned on. For example, when the correspondence between each bit of the data sfc and the subfields sf1 to sf6 is in a relationship shown in the lower portion of FIG. 12, the selector 1220 may be constructed as shown in FIG. 12.

In the configuration shown in FIG. 12, for example, in a case where the most significant bit (MSB), the second significant bit (2SB), and the least significant bit (LSB) of the data sfc are at L, H, and H levels, respectively, and indicates the subfield sf4, only the path between one end of the holding element C4 and the node A is turned on, and the voltage of the ON display signal Vbk or the OFF display signal Vwt in accordance with the logic level at one end of the holding element C4 is applied to the pixel electrode 118.

In such a configuration, since the path length between one end of the holding element selected by the selector 1220 and the node A which is the input/output end of the latch circuit is shorter than that of the configuration shown in FIG. 3, the capacitance parasitic to the path can be decreased. For this reason, according to the selector 1220 shown in FIG. 12, when the bits of the gray scale data are transferred from one of the holding elements, since the amount of charge lost by charge sharing can be reduced, the bits can be more reliably transferred correspondingly.

FIG. 12 shows the configuration in a case where such a selector 1220 is applied to the first embodiment, and the selector 1220 can also be applied to the second embodiment. In a case where the selector 1220 can be applied to the second embodiment, data sfc sampled in accordance with a transfer signal Ysi by the shift register 130 of the i-th row may be supplied to the pixel 120 of the i-th row.

<3-2: Another Example for AC Driving>

In the first and second embodiments, the Vbk selector 134 selects one of the ON display signal Vbk (+) on the higher potential side and the ON display signal Vbk (−) on the lower potential side in accordance with the signal FLD, so that AC driving of the liquid-crystal capacitor is performed. The configuration may also be formed in such a way that (the inverted signal of) the signal FLD is directly supplied to the pixel 120 and the ON display signal is selected in accordance with this signal.

More specifically, the configuration may be formed in such a way that the inverted signal of the signal FLD, the ON display signal Vbk (+) on the higher potential side, and the ON display signal Vbk (−) on the lower potential side are commonly supplied in the row direction with respect to the pixel 120 and that the complementary switch 1251 in FIG. 3 is replaced with a complementary switch 1255, as shown in FIG. 13. Here, the complementary switch 1255, between the ON display signal Vbk (+) on the higher potential side and the ON display signal Vbk (−) on the lower potential side, comprises a first p-channel-type TFT in which the output of the inverter 1241 is used as the gate, a second p-channel-type TFT in which the inverted signal of the signal FLD is used as the gate, a first n-channel-type TFT in which, the inverted signal is used similarly as the gate, and a second n-channel-type TFT in which the output of the inverter 1243 is used as the gate, which are connected in series, wherein the common output end of the second p-channel-type TFT and the first n-channel-type TFT is connected to the pixel electrode 118.

According to this configuration, if the node A is at an L level, the OFF display signal Vwt is applied to the pixel electrode 118 as a result of the complementary switch 1251 being turned on. In contrast, if the node A is at an H level and the inverted signal of the signal FLD is at an L level, the ON display signal Vbk (+) on the higher potential side selected by the complementary switch 1255 is applied to the pixel electrode 118. Furthermore, if the node A is at an H level and the inverted signal of the signal FLD is at an H level, the ON display signal Vbk (−) on the lower potential side selected by the complementary switch 1255 is applied to the pixel electrode 118.

FIG. 13 shows the construction in a case where such a complementary switch 1255 is applied to the first embodiment, and the complementary switch 1255 can also be applied to the second embodiment. In a case where the complementary switch 1255 is applied to the second embodiment, the inverted signal of the signal FLD sampled in accordance with the transfer signal Ysi by the shift register 130 of the i-th row is supplied to the pixel 120 of the i-th row.

Furthermore, if the noninverted signals of the signal FLD, which are sampled in accordance with the transfer signals Ysi(i−1) and Ysi(i+1) are supplied to the (i−1) and (i+1) rows adjacent to the i-th row, respectively, the writing polarities of the adjacent rows are in a relationship of inversion with respect to each other, thereby making it possible to reduce, minimize or prevent a flicker.

<3-3: Others>

Although in the above-described first and second embodiments, a color display of 260,000 colors is made possible by performing 64 gray shades using 6-bit gray scale data per color for each of RGB, the present invention is not limited thereto. For example, the number of bits may be increased so as to produce a color display of a greater number of gray shades, the number of bits of the gray scale data may be different for each color of RGB, and, furthermore, a simple gray scale display of black and white may be produced.

In addition, although in the embodiments, a transmission type is used, a reflection type may be used, and a semi-transmission/semi-reflection type, in which a transmission type and a reflection type are combined, may be used.

Although in the above-described embodiments, AC driving is performed by inverting the writing polarity of the liquid-crystal capacitor for each field, the present invention is not limited thereto. For example, the configuration may be formed in such a way that inversion driving is performed at a cycle of two or more fields or inversion driving is performed at subfield units. Furthermore, although the above-described embodiments are described as a normally white mode in which a maximum transmittance is reached in the voltage non-applied state of the liquid-crystal capacitor, a normally black mode in which a minimum transmittance is reached in the same state may also be used.

Furthermore, although in the embodiments, a glass substrate is used for the component substrate 101, the technology of SOI (Silicon On Insulator) may be used, so that a silicon single-crystal film is formed on an insulating substrate, such as sapphire, quartz, or glass, and various components are made thereon, forming the component substrate 101. Also, a silicon substrate may be used for the component substrate 101, and various components may be formed thereon. In such a case, since high-speed field-effect-type transistors may be used as switching elements, a higher-speed operation than that of a TFT becomes easier. However, when the component substrate 101 is not transparent, it is necessary to form the pixel electrode 118 using aluminum or to separately form a reflection layer, so that the component substrate is used as a reflection type.

Furthermore, although in the above-described embodiments a TN type liquid crystal is used, a liquid crystal may be used, which is of a bistable type having the memory property, such as a BTN (Bistable Twisted Nematic) type or a ferroelectric type; a highpolymer dispersion type; and a GH (Guest and Host) type in which a dye (guest) having anisotropy in the absorption of visible light between the longer-axis direction and the shorter-axis direction of molecules is dissolved in a liquid crystal (host) of a predetermined molecular orientation, and the dye molecules are oriented parallel to the liquid-crystal molecules.

Furthermore, vertical orientation (homeotropic orientation) may be formed such that the liquid-crystal molecules are oriented vertical to both substrates when no voltage is applied, whereas, when a voltage is applied, the liquid-crystal molecules are oriented parallel to both substrates. Furthermore, parallel (horizontal) orientation (homogeneous orientation) may be formed such that the liquid-crystal molecules are oriented horizontal to both substrates when no voltage is applied, whereas, when a voltage is applied, the liquid-crystal molecules are oriented vertical to both substrates. As described above, the present invention can be applied to various liquid crystals and alignment methods.

Additionally, in addition to liquid-crystal display devices as electro-optical devices, the present invention can be applied to various electro-optical devices which use electroluminescence (EL), plasma light emission, and fluorescence by electron emission in order to produce a display by the electro-optical effect thereof. In this case, the electro-optical materials may be EL, mirror devices, gas, fluorescent substances. When EL is used as the electro-optical material, since EL is interposed between the pixel electrode 118 and the transparent conductive film on the component substrate 101, the opposing substrate 102, which is necessary as the liquid-crystal display device, becomes unnecessary. As described above, the present invention can be applied to all electro-optical devices having a construction similar to the above-described constructions.

<4: Electronic Apparatus>

Next, a description is provided of some electronic apparatuses which use an electro-optical device according to the above-described embodiments.

<4-1: Projector>

First, a description is provided of a projector in which the above-described electro-optical device 100 is used as a light valve. FIG. 14 is a plan view showing this projector.

As shown in FIG. 14, a projector 2100 is internally provided with a lamp unit 2102, such as a halogen lamp, formed of a white light source. The projected light emitted from this lamp unit 2102 is separated into the three primary colors of RGB by three mirrors 2106 and two dichroic mirrors 2108 which are arranged internally, and these primary colors are guided into the light valves 100R, 100G, and 100B corresponding to the primary colors, respectively.

Here, the light valves 100R, 100G, and 100B are basically the same as the electro-optical device 100 according to the above-described embodiments. One dot is not formed by the three pixels of RGB, and instead one dot of the primary color is formed by one pixel. That is, the light valve 100R is driven by R image data DR, the light valve 100G is driven by G image data DG, and the light valve 100B is driven by B image data DB, so that they function as a light modulator which creates each primary-color image of RGB.

Also, since the optical path of the B light is longer than that of the other R and G light, in order to prevent the loss, light is guided via a relay lens system 2121 formed of an incidence lens 2122, a relay lens 2123, and an exit lens 2124.

The light, which is modulated by the light valves 100R, 100G , and 100B, respectively, enters a dichroic prism 2112 from three directions. Then, in this dichroic prism 2112, the R and B light is refracted by 90 degrees, whereas the G light travels straight. As a result, a color image in which the primary-color images are combined is projected onto a screen 2120 via a projection lens 2114.

Since light corresponding to each primary color of RGB enters the light valves 100R, 100G, and 100B by means of the dichroic mirrors 2108, there is no need to provide color filters therein as described above.

<4-2: Mobile Computer>

Next, a description is provided of an example in which the electro-optical device 100 is applied to a mobile personal computer. FIG. 15 is a perspective view showing the construction of this personal computer. In FIG. 15, a computer 2200 includes a main unit 2204 including a keyboard 2202, and an electro-optical device 100 used as a display section. In a case where a liquid-crystal display device is used as the electro-optical device 100, a backlight unit (not shown) that ensures visibility in a dark place is provided in the rear.

<4-3: Portable Phone>

Furthermore, a description is provided of an example in which the electro-optical device 100 is applied to a display section of a portable phone. FIG. 16 is a perspective view showing the construction of this portable phone. In FIG. 16, a portable phone 2300 includes a plurality of operation buttons 2302, an earpiece 2304, a mouthpiece 2306, as well as the electro-optical device 100. In a case where a liquid-crystal display device is used as the electro-optical device 100, similar to the above-described personal computer, a backlight unit (not shown) for ensuring visibility in a dark place is provided in the rear.

<4-4: Summary of Electronic Apparatus>

The invention can be used with virtually any suitable type of electronic apparatus. Other exemplary electronic apparatus include, in addition to those described with reference to FIGS. 14, 15, and 16, a liquid-crystal television, a viewfinder-type/monitor-direct view-type video tape recorder, a car navigation apparatus, a pager, an electronic notebook, an electronic calculator, a word processor, a work station, a television phone, a POS terminal, a digital still camera, and a device having a touch panel. It is a matter of course that the electro-optical device according to the embodiments and according to the applications can be applied to these various types of electronic apparatuses.

As has thus been described, according to the present invention, a high-quality display, in which the occurrence of display variations arising from the nonuniformity of various element characteristics, wiring resistance, etc., is reduced, becomes possible with low power consumption.

What is claimed is:

1. A gray scale display method for providing memories that respectively store each bit of gray scale data which indicates gray shade and that cause pixels arranged in a matrix in the row direction and in the column direction to produce a gray scale display, said gray scale display method comprising the steps of:

dividing one field into subfields corresponding to bits of said gray scale data;

setting a period of each subfield in such a manner as to correspond to a weight of each of said bits;

in each subfield and with respect to each pixel having a plurality of bit memories and a self-rewritable memory, reading, from one of the said memories, a bit corresponding to the subfield within the gray scale data corresponding to the pixel, latching the bit, producing at least one of an ON display and an OFF display according to the bit, and writing the latched bit to the one of the memories via said self-rewritable memory.

2. An electro-optical device which has pixels arranged in a matrix in a row direction and in a column direction, which divides one field into subfields corresponding to bits of gray scale data, which sets a period of each subfield in such a manner as to correspond to a weight of each of said bits, and which causes each of said pixels to produce at least one of an ON display and an OFF display according to the corresponding bits within said gray scale data, said electro-optical device comprising for each of said pixels:

a plurality of memories, each storing a respective bit of said gray scale data;

a self-rewritable memory;

a selector that selects a memory, that stores a bit corresponding to a subfield, from among said plurality of memories;

a latch circuit that reads and latches the bit stored in the memory selected by said selector, and that rewrites in the memory via the self-rewritable memory;

an on/off selection switch that selects a voltage corresponding to an ON display or an OFF display in accordance with the bit read from the memory selected by said selector; and a pixel electrode to which the voltage selected by said on/off selection switch is applied.

3. The electro-optical device according to claim 2, said memory including:

a first transfer switch that transfers the bits of said gray scale data when a writing control signal indicating a bit writing timing switches to an active level; and a holding element that holds a voltage corresponding to the bits transferred by said transfer switch.

4. The electro-optical device according to claim 2, further comprising a rewriting prohibition switch that prohibits rewriting to a memory until said latch circuit reads the bits stored in the memory selected by said selector and latches the bits.

5. The electro-optical device according to claim 2, further comprising a second transfer switch that transfers a writing permission signal which permits rewriting when a writing control signal indicating a bit writing timing switches to an active level, said memory writing the bits of said gray scale data only when the writing permission signal transferred by said second transfer switch is at an active level.

6. The electro-optical device according to claim 2, the selection by said on/off selection switch being performed simultaneously in all the pixels in each subfield.

7. The electro-optical device according to claim 2, the selection by said on/off selection switch being performed sequentially for each row in each subfield.

8. The electro-optical device according to claim 2, said selector including switching elements which are interposed between each of said memories and said latch circuit and which are turned on in accordance with a subfield selection signal in which only one of the switching elements exclusively switches to an active level for each subfield.

9. The electro-optical device according to claim 2, said selector including a plurality of switching elements which cause only one of paths within the paths between each of said memories and said latch circuit to be exclusively turned on in accordance with data which specifies the subfield.

10. The electro-optical device according to claim 2, further comprising an opposing electrode which opposes said pixel electrode via an electro-optical material, a voltage corresponding to said OFF display being made to be substantially the same as the applied voltage of said opposing electrode, a voltage corresponding to said ON display being inverted with respect to the voltage corresponding to said OFF display and is supplied for one or more fields.

11. The electro-optical device according to claim 2, further comprising an opposing electrode which opposes said pixel electrode via an electro-optical material, a voltage corresponding to said OFF display being made to be substantially the same as the applied voltage of said opposing electrode, said on/off selection switch alternately selecting, for one or more fields, a positive-polarity-side voltage and a negative-polarity-side voltage, in which the voltage differences with respect to the voltage corresponding to said OFF display are nearly equal, in accordance with a polarity signal indicating a writing polarity when the voltage corresponding to said ON display is selected.

12. An electronic apparatus, comprising:

the electro-optical device according to claim 2.

* * * * *